US010944225B2

(12) United States Patent
Lybrand

(10) Patent No.: US 10,944,225 B2
(45) Date of Patent: Mar. 9, 2021

(54) SELF SHORTING CONNECTOR

(71) Applicant: AVX, Fountain Inn, SC (US)

(72) Inventor: Brent Lybrand, Fountain Inn, SC (US)

(73) Assignee: AVX Corporation, Fountain Inn, SC (US)

( * ) Notice: Subject to any disclaimer, the term of this patent is extended or adjusted under 35 U.S.C. 154(b) by 0 days.

(21) Appl. No.: 16/823,956

(22) Filed: Mar. 19, 2020

(65) Prior Publication Data

US 2020/0313375 A1 Oct. 1, 2020

Related U.S. Application Data

(60) Provisional application No. 62/825,372, filed on Mar. 28, 2019.

(51) Int. Cl.

| | |
|---|---|
| ***H01R 31/08*** | (2006.01) |
| ***H01R 13/08*** | (2006.01) |
| ***H01R 13/627*** | (2006.01) |
| ***H01R 13/58*** | (2006.01) |

(52) U.S. Cl.
CPC ..... *H01R 31/08* (2013.01); *H01R 13/08* (2013.01); *H01R 13/5845* (2013.01); *H01R 13/6272* (2013.01)

(58) Field of Classification Search
CPC ..... H01R 31/08; H01R 31/085; H01R 13/08; H01R 13/5845; H01R 13/6272
USPC ..... 439/188, 507–514
See application file for complete search history.

(56) References Cited

U.S. PATENT DOCUMENTS

| | | | | |
|---|---|---|---|---|
| 3,519,975 | A * | 7/1970 | Prow, Jr. | H01R 13/4538 439/271 |
| 3,600,531 | A * | 8/1971 | Hoegerl | H01R 13/7031 200/51.1 |
| 5,052,940 | A * | 10/1991 | Bengal | H01R 9/032 439/188 |
| 9,293,845 | B2 | 3/2016 | Jeon et al. | |
| 2011/0117770 | A1 | 5/2011 | Lindkamp | |
| 2013/0157519 | A1 | 6/2013 | Ohkuma | |
| 2017/0033480 | A1 | 2/2017 | Sato | |
| 2018/0166838 | A1 | 6/2018 | Lybrand | |

OTHER PUBLICATIONS

International Search Report and Written Opinion in PCT/IB2020/052773 dated Jul. 3, 2020, 9 pages.

* cited by examiner

*Primary Examiner* — Khiem M Nguyen
(74) *Attorney, Agent, or Firm* — Foley & Lardner LLP

(57) ABSTRACT

A system including an electrical header connector assembly is provided. The electrical header connector assembly includes an insulated body with a mating body portion and a strain relief portion, a first self-shorting contact and a second self-shorting contact. Each self-shorting contact includes a contact tail with a wire receiving recess and a contact blade extending opposite and substantially parallel to the contact tail. Each self-shorting contact further includes a shorting beam extending opposite the contact tail. The shorting beam includes a curved portion extending away from the contact blade and a bent tip portion extending toward the contact blade. The shorting beam of the first self-shorting contact is configured to touch the shorting beam of the second self-shorting contact when the electrical header is in a neutral position.

21 Claims, 17 Drawing Sheets

Section B-B

Section A-A

Section C-C

Section D-D

SELF SHORTING CONNECTOR

CROSS-REFERENCE TO RELATED APPLICATION

This application claims priority to U.S. Provisional Patent Application No. 62/825,372, filed Mar. 28, 2019, the entirety of which is incorporated herein by reference.

FIELD

The present application relates generally to field of electrical connectors, and more particularly to a self-shorting connector pair that protects against static discharge damage during a mating process.

BACKGROUND

The following description is provided to assist the understanding of the reader. None of the information provided or references cited are admitted to be prior art.

Various types of connectors are used for forming connections between two wires or between a wire and an electronic component. Electrostatic discharge (ESD) is the release of static electricity when two objects come into contact. ESD is a major cause of intermittent or complete failure in electrical components, and electrical connectors are particularly susceptible to ESD during a connector mating process. Thus, an electrical contact design that minimizes the risk due to ESD during the process of mating a header connector to a receptacle connector is needed.

SUMMARY

The systems, methods, and devices of this disclosure each have several innovative aspects, no single one of which is solely responsible for the desirable attributes disclosed herein. One embodiment of the invention relates to a system. The system includes an electrical header connector assembly. The electrical header connector assembly includes an insulated body with a mating body portion and a strain relief portion, a first self-shorting contact and a second self-shorting contact. Each self-shorting contact includes a contact tail with a wire receiving recess and a contact blade extending opposite and substantially parallel to the contact tail. Each self-shorting contact further includes a shorting beam extending opposite the contact tail. The shorting beam includes a curved portion extending away from the contact blade and a bent tip portion extending toward the contact blade. The shorting beam of the first self-shorting contact is configured to touch the shorting beam of the second self-shorting contact when the electrical header is in a neutral position.

Another embodiment of the invention is a self-shorting contact for an electrical connector. The self-shorting contact includes a contact tail with a wire receiving recess and a contact blade extending opposite and substantially parallel to the contact tail. The self-shorting contact further includes a shorting beam extending opposite the contact tail. The shorting beam includes a curved portion extending away from the contact blade and a bent tip portion extending toward the contact blade.

Yet another embodiment of the invention is a method of electrically coupling a header connector assembly with self-shorting contacts and a receptacle connector assembly. The method includes moving the header connector assembly and the receptacle connector assembly to a first contact position. The first contact position includes a first contact blade and a second contact blade of the header connector assembly aligned with a first receptacle contact and a second receptacle contact of the receptacle connector assembly and a first shorting beam and a second shorting beam of the header connector assembly in contact with each other. The method further includes moving the header connector assembly and the receptacle connector assembly to a first break position. The first break position includes the first contact blade in contact with the first receptacle contact and the second contact blade in contact the second receptacle contact, and the first shorting beam and the second shorting beam in contact with each other and an insulating interrupting wall of the receptacle connector assembly. The method further includes moving the header connector assembly and the receptacle connector assembly to a fully mated position. The fully mated position includes the first contact blade electrically coupled with the first receptacle contact and the second contact blade electrically coupled with the second receptacle contact, and the first shorting beam and the second shorting beam spaced apart from each other and both in contact with the insulating interrupting wall.

DETAILED DESCRIPTION

Reference will now be made to various embodiments, one or more examples of which are illustrated in the figures. The embodiments are provided by way of explanation of the invention, and are not meant as a limitation of the invention. For example, features illustrated or described as part of one embodiment may be used with another embodiment to yield still a further embodiment. It is intended that the present application encompass these and other modifications and variations as come within the scope and spirit of the invention.

Figure 1:
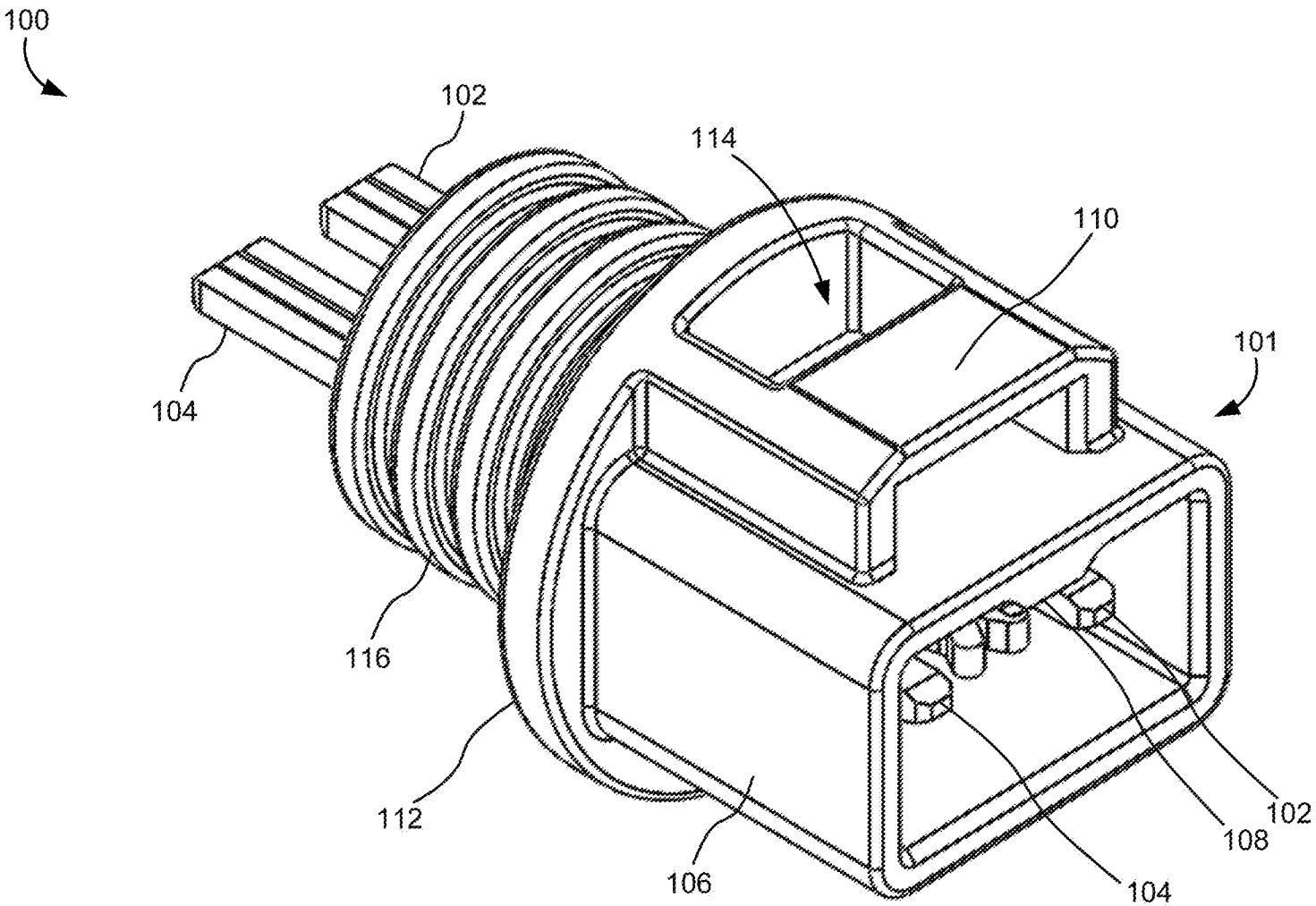
FIG. 1 depicts a perspective view of a header connector assembly in accordance with an illustrative embodiment.

Referring to FIG. 1, a perspective view of a header connector assembly 100 is depicted in accordance with an illustrative embodiment. The header connector assembly 100 is shown to include a first shorting contact 102 and a second shorting contact 104 within an insulated body 101. First shorting contact 102 and second shorting contact 104 may be fabricated from an electrically conductive material. Further details regarding the first and second shorting contacts 102 and 104 are included below with reference to FIGS. 2 and 3.

The insulated body 101 is shown to include a mating body portion 106, a latching body portion 110, a cylindrical flange portion 112, and a strain relief portion 116. In an exemplary embodiment, insulated body 101 is fabricated as a single part. In other embodiments, one or more of the mating body portion 106, latching body portion 110, cylindrical flange portion 112 and strain relief portion 116 are fabricated as separate parts and assembled into insulated body 101. In some embodiments, the insulated body 101 or portions thereof may be fabricated out of a higher glass content resin for better heat stability. In other embodiments, the insulated body 101 or portions thereof may be composed of other materials.

Mating body portion 106 is configured to protect the first shorting contact 102 and the second shorting contact 104 from damage when the contacts 102, 104 are coupled to receptacle contacts of a receptacle assembly. As depicted in FIG. 1, mating body portion 106 may be substantially box-shaped with a rectangular cross-section, although mating body portion 106 may have any shape or geometry desired to at least partially encapsulate the shorting contacts 102, 104 and to receive a mating portion of a receptacle connector assembly. Mating body portion 106 is further shown to include an alignment tab 108. Alignment tab 108 may be configured to couple with a notch located on the mating receptacle assembly to ensure the proper alignment of the shorting contacts 102, 104 relative to receptacle contacts and the formation of a good electrical connection between the header connector assembly 100 and a receptacle connector assembly during a mating process. Although depicted in FIG. 1 as situated above the shorting contacts 102, 104, alignment tab 108 may be in any desired orientation relative to the shorting contacts 102, 104.

Latching body portion 110 is shown to extend above the mating body portion 106 with a substantially U-shaped cross-section. Latching body portion 110 may be configured to receive a latch portion of a receptacle connector assembly to ensure secure mating of the header connector assembly 100 and a receptacle connector assembly. Latching body portion 110 is shown to include a latch recess 114 proximate the cylindrical flange portion 112. In various embodiments, a tab on the latch portion of the receptacle connector assembly may be configured to extend through the latch recess 114 to act as a mechanical stop against a force acting to separate the header connector assembly 100 and a receptacle connector assembly.

Insulated body 101 further includes cylindrical flange portion 112 and strain relief portion 116. Both cylindrical flange portion 112 and strain relief portion 116 may act as grip surfaces for a user during the mating of the header connector assembly 100 and a receptacle connector assembly. Strain relief portion 116 may further function to protect the terminations of wires received by the shorting contacts 102, 104 by preventing the transmission of any forces exerted on the wires to the terminations.

Figure 2:
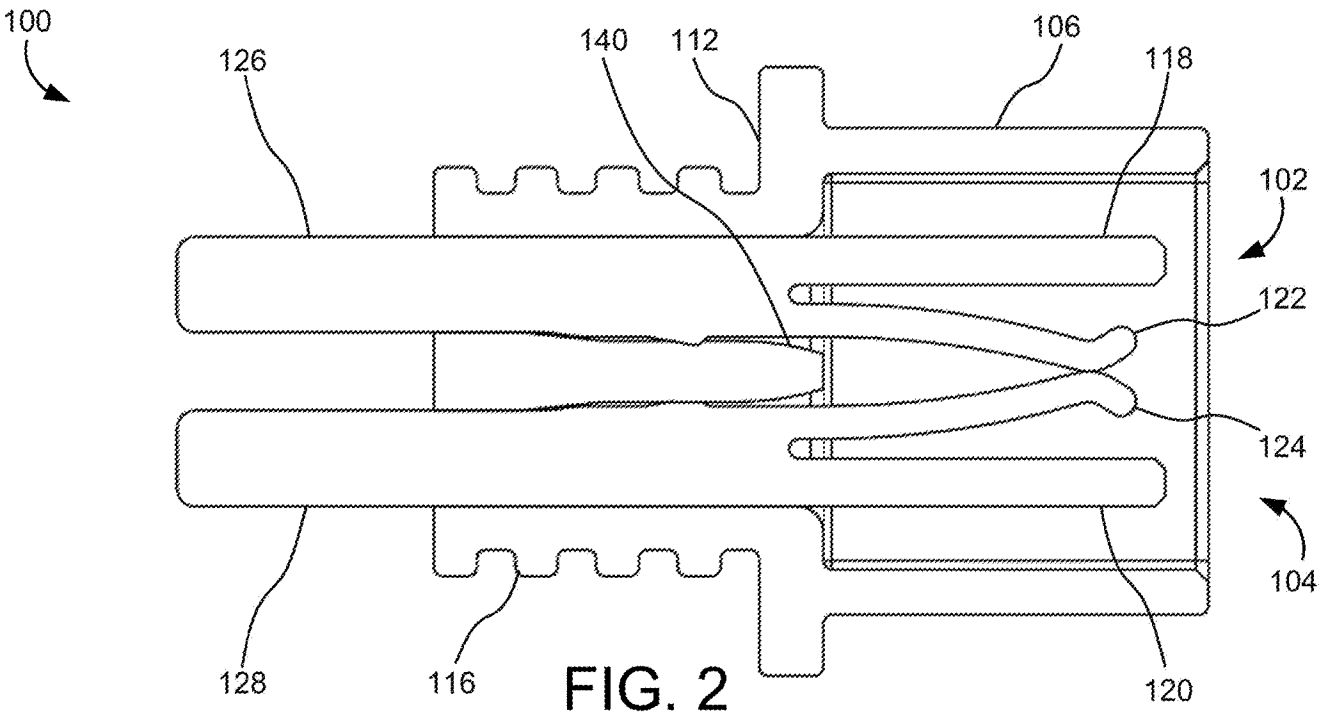
FIG. 2 depicts a top cross-sectional view of the header connector assembly in accordance with an illustrative embodiment.

Referring now to FIG. 2, a top cross-sectional view of the header connector assembly 100 is depicted in accordance with an illustrative embodiment. As shown, the first shorting contact 102 includes a first contact blade 118, a first shorting beam 122, and a first contact tail 126. The second shorting contact 104 similarly includes a second contact blade 120, a second shorting beam 124, and a second contact tail 128. First shorting contact 102 and second shorting contact 104 may be separated by an insulating wall 140 of the strain relief portion 116 such that the only point of contact between the first shorting contact 102 and the second shorting contact 104 is in the region of the shorting beams 122, 124 when the header connector assembly 100 is in a nominal (i.e., unmated) configuration.

Figure 3:
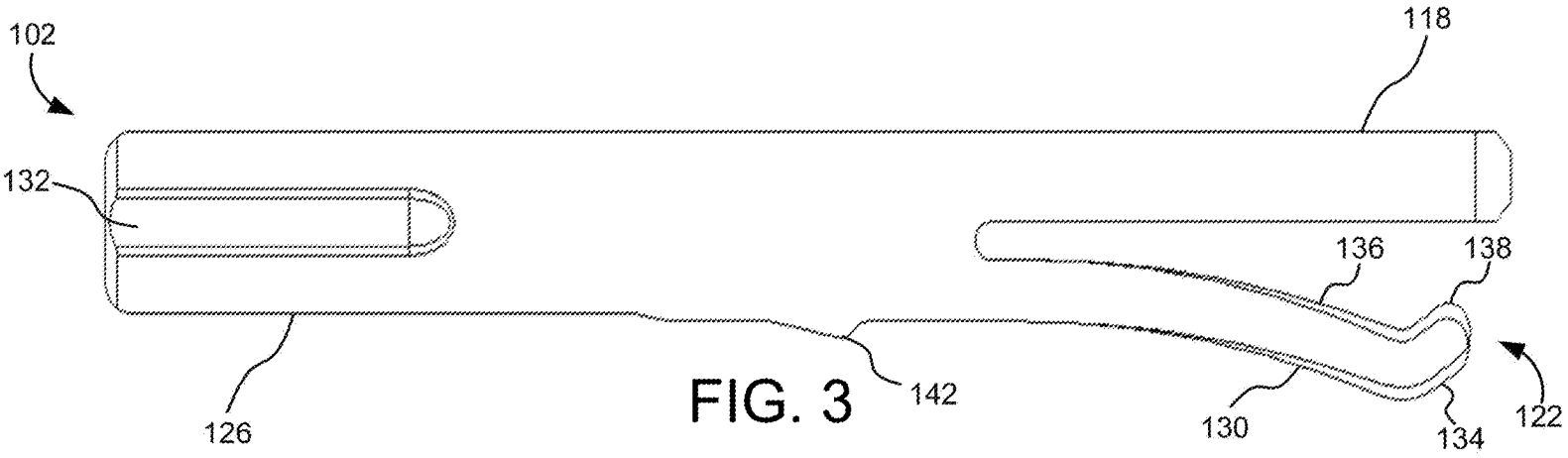
FIG. 3 depicts a top cross-sectional view of a contact with a shorting beam in accordance with an illustrative embodiment.

Turning now to FIG. 3, a top cross-sectional view of the first shorting contact 102 is depicted in accordance with an illustrative embodiment. Although the disclosure below is described exclusively with reference to the first shorting contact 102, the second shorting contact 104 may be identical or substantially similar to the first shorting contact 102, and all disclosure is equally applicable to the second shorting contact 104. First shorting contact 102 and second shorting contact 104 can be fabricated using any suitable process (e.g., a forming process).

As described above, the first shorting contact 102 is shown to terminate in a contact tail 126 with a wire receiving recess 132 at one end. The first shorting contact 102 is further shown to terminate in a contact blade 118 and a shorting beam 122 at the end opposite the contact tail 126. The contact blade 118 may be substantially parallel to the contact tail 126. Between the contact tail 126 and the shorting beam 122, the contact 102 may include retention features 142. Retention features 142 may be configured to grip the insulating wall 140 (depicted in FIG. 2) to prevent removal of the first shorting contact 102 from the header connector assembly 100.

In some embodiments, the overall length of the first shorting contact 102 is approximately (i.e., ±0.05 inches) 0.45 inches. In various embodiments, the depth the wire receiving recess extends into the first contact 126 is approximately 0.10 inches. Wire receiving recess 132 may be configured to terminate a wire using any suitable means (e.g., crimping, soldering). In other embodiments, the recess 132 may be configured to receive another component (e.g., a resistor or capacitor). In still further embodiments, the recess 132 does not receive a wire termination, and the first shorting contact 102 is instead soldered to a printed circuit board (PCB).

Still referring to FIG. 3, the first shorting beam 122 is depicted both in the neutral position and a deflected position. First shorting beam 122 is shown to include a curved portion 130 and a bent tip portion 134, both depicted in the neutral position. Curved portion 130 is shown to extend away from the contact blade 118, while bent tip portion 134 extends toward the contact blade 118. In some embodiments, the terminating end 119 of the contact blade 118 extends past the terminating end of the bent tip portion 135. First shorting beam 122 may include any dimensions (e.g., radius of curvature, thickness, angle between curved portion 130 and bent tip portion 134) required to ensure contact with the second shorting beam 124 when header connector assembly 100 is in the neutral position, and to permit deflection without deformation when header connector assembly 100 is in a mating (i.e., deflected) position. In the deflected position, the shorting beam 122 is shown to include a curved portion 136 and a bent tip portion 138. In some embodiments, the neutral position reflects an application of preload to the first shorting beam 122. The application of preload may ensure that the first shorting beam 122 and the second shorting beam 124 remain in contact with each other when the header connector assembly 100 is in an unmated condition. Further details of the mating process for the header connector assembly 100 are included below with reference to FIGS. 16-21.

Figure 4:
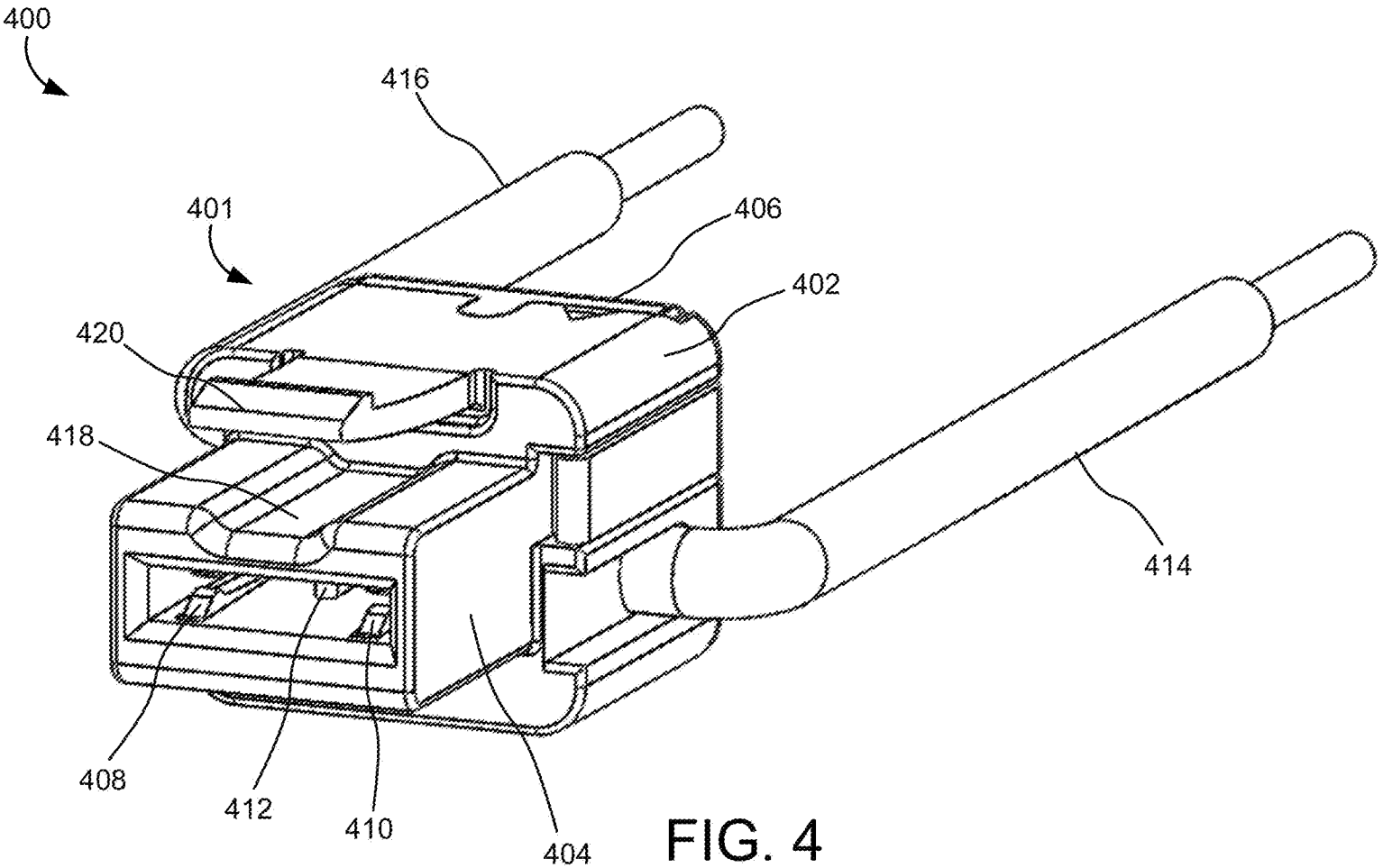
FIG. 4 depicts a perspective view of a receptacle connector assembly in accordance with an illustrative embodiment.
Figure 5:
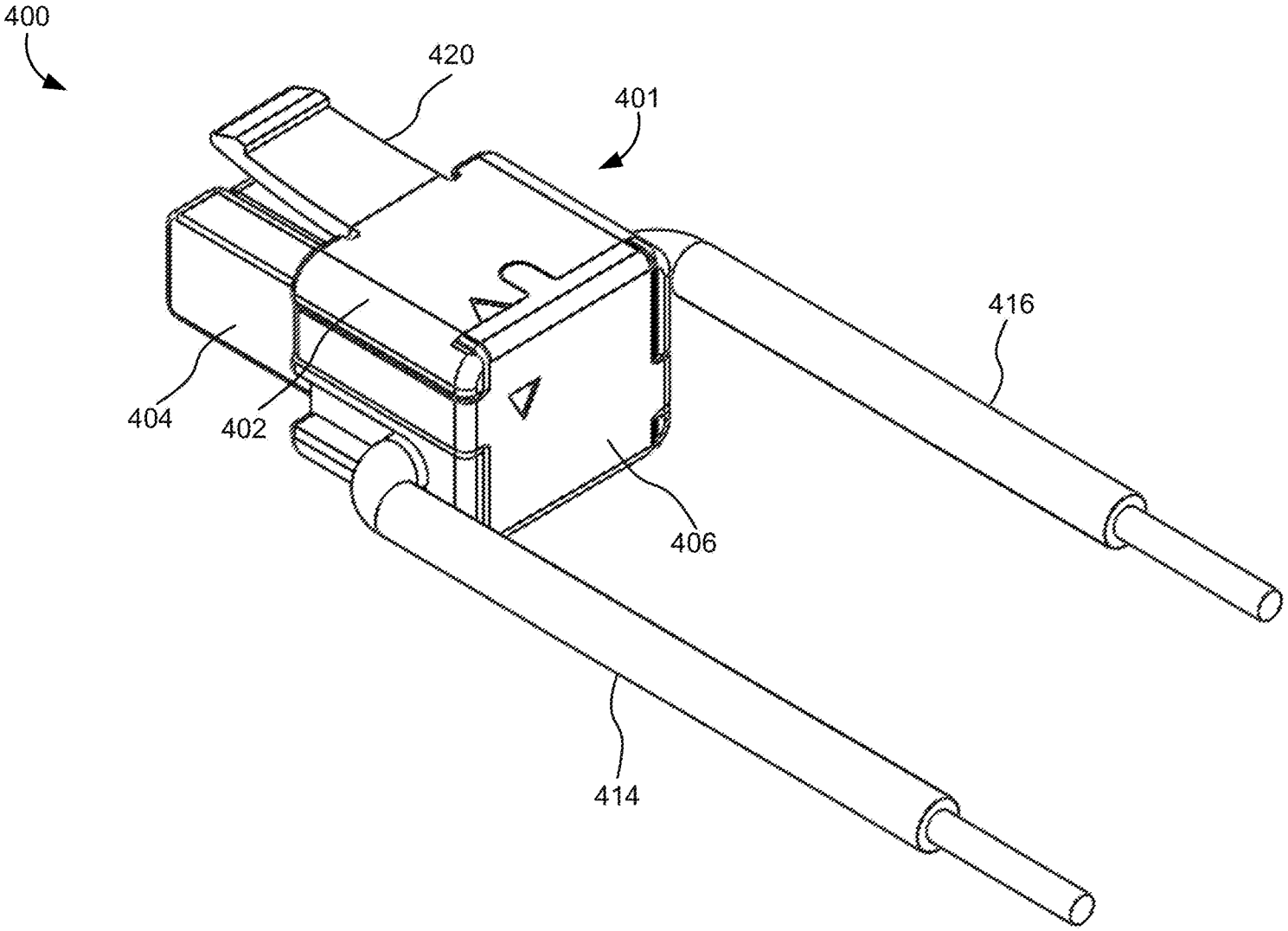
FIG. 5 depicts another perspective view of the receptacle connector assembly of FIG. 4 in accordance with an illustrative embodiment.

Turning now to FIGS. 4 and 5, perspective views of a receptacle connector assembly 400 are depicted in accordance with an illustrative embodiment. Receptacle connector assembly 400 is shown to include a first receptacle contact 408 and a second receptacle contact 410 within an insulated body 401. In an exemplary embodiment, the receptacle connector assembly 400 is configured to mate with the header connector assembly 100 depicted in FIGS. 1-2 such that the first shorting contact 102 is electrically coupled to the first receptacle contact 408 and the second shorting contact 104 is electrically coupled to the second receptacle contact 410.

Figure 10:
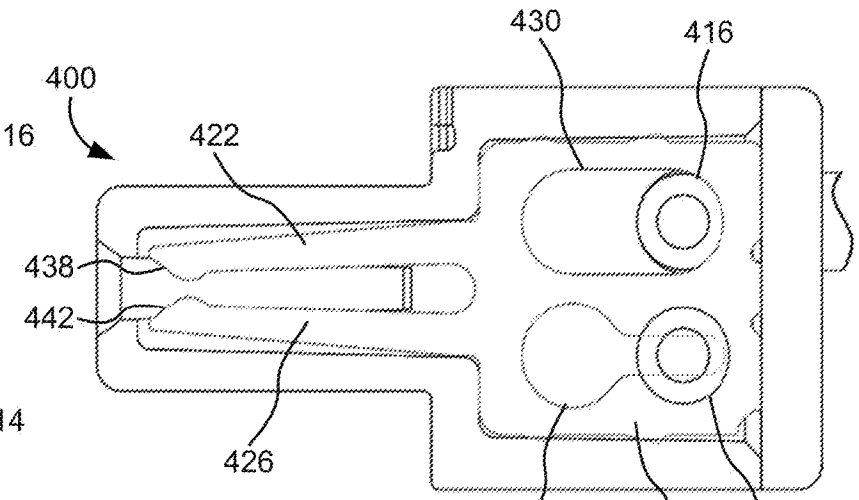
FIG. 10 is a side cross-sectional view of the receptacle connector assembly taken along the line B-B of FIG. 8, in accordance with an illustrative embodiment.
Figure 9:
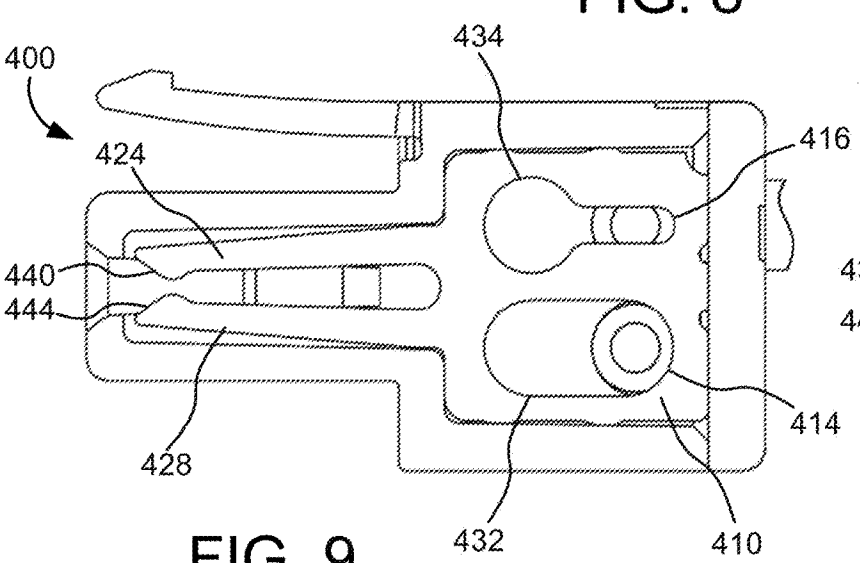
FIG. 9 is a side cross-sectional view of the receptacle connector assembly taken along the line A-A of FIG. 8, in accordance with an illustrative embodiment.

Insulated body 401 is shown to include a main body portion 402 and a mating body portion 404. Main body portion 402 may be configured to house the terminations of first wire 414 and second wire 416. First wire 414 may be electrically coupled to the first receptacle contact 408, while second wire 416 may be electrically coupled to the second receptacle contact 410. Mating body portion 404 may be configured to house the contact blades of first receptacle contact 408 and second receptacle contact 410, described in further detail below with reference to FIGS. 9 and 10.

In some embodiments, insulated body 401 is fabricated as a single part. In other embodiments, main body portion 402 and mating body portion 404 are fabricated as separate parts and later assembled into insulated body 401. Both main body portion 402 and mating body portion 404 may be substantially box-shaped with a rectangular cross-section, although main body portion 402 and mating body portion 404 may have any shape or geometry (e.g., cylindrical) desired to house the terminations of first wire 414 and second wire 416 and to permit the mating body portion 404 to be inserted into the mating body portion 106 of the header connector assembly 100.

Mating body portion 404 is further shown to include an interrupting wall 412 situated between the receptacle contacts 408, 410, and an alignment notch 418 situated above the interrupting wall 412. Interrupting wall 412 may be configured to contact the shorting beams 122, 124 of the shorting contacts 102, 104 during the mating process of header connector assembly 100 and receptacle connector assembly 400. Further details of the mating process are included below with reference to FIGS. 16-21.

Insulated body 401 may include one or more features configured to align the receptacle connector assembly 400 relative to the header connector assembly 100. For example, alignment notch 418 may be configured to receive the alignment tab 108 of the header connector assembly 100. The coupling of the alignment tab 108 and the alignment notch 418 may ensure proper alignment of the mating body portion 404 as it is inserted into the mating body portion 106 of the header connector assembly 100 and the formation of a good electrical connection between shorting contacts 102, 104 and receptacle contacts 408, 410.

Latch 420 may be configured to prevent decoupling of the header connector assembly 100 and the receptacle connector assembly 400 from a fully mated position. As shown, latch 420 may extend over the mating body portion 404 and may include one or more curved surfaces such that latch 420 bends away from the mating body portion 404. A user may depress the latch 420 toward the mating body portion 404 in order to decouple the receptacle connector assembly 400 from the header connector assembly 100.

The receptacle connector assembly 400 is further shown to include an insulated cap 406. Insulated cap 406 may be detachably coupled to the main body portion 402 of the insulated body 401. Insulated cap may be configured to protect the first receptacle contact 408, the second receptacle contact 410, first wire 414, and second wire 416 against damage due to shorting and ESD. In various embodiments, insulated cap 406 may be coupled to the main body portion 402 using a snap fit assembly process.

Figure 6:
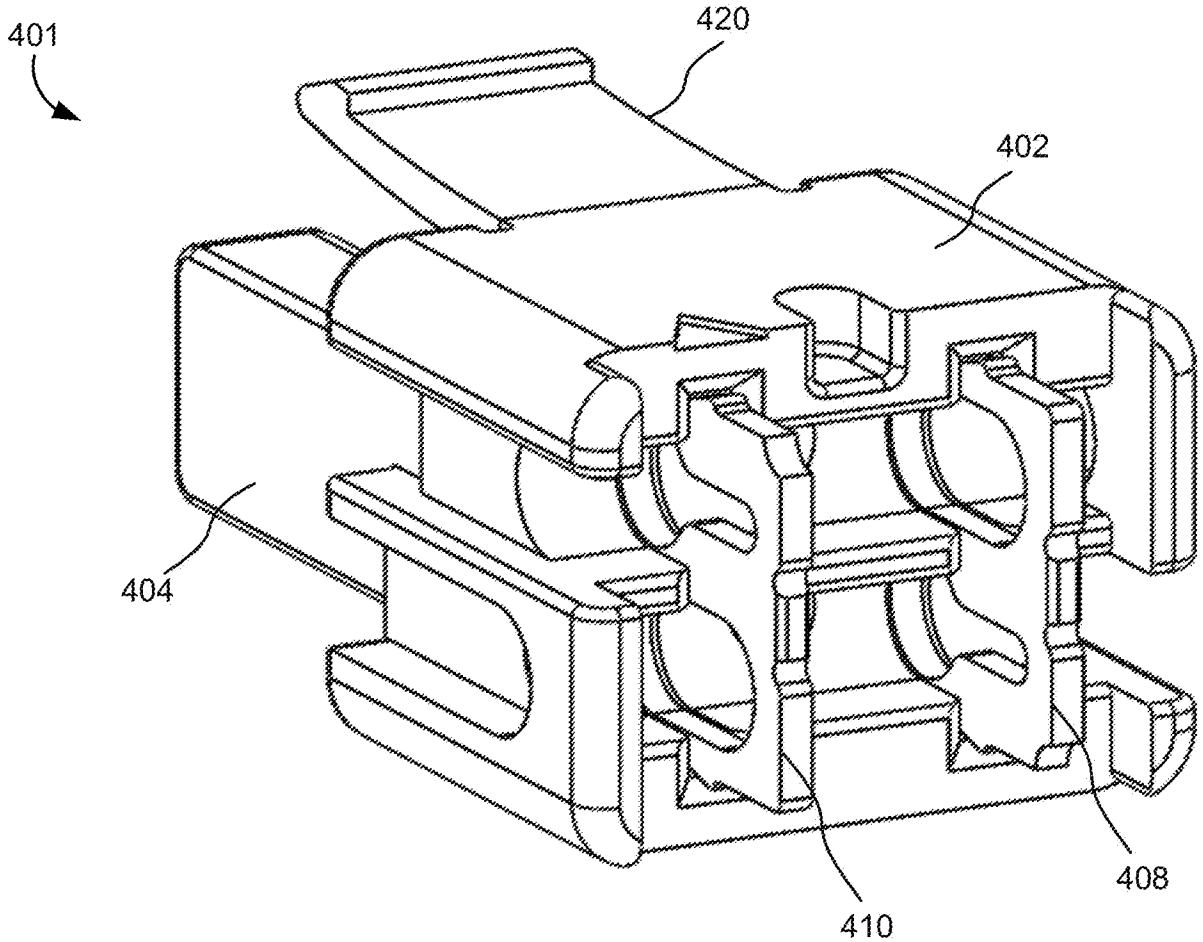
FIG. 6 depicts a perspective view of a subassembly of the receptacle connector assembly of FIG. 4 in accordance with an illustrative embodiment.
Figure 7:
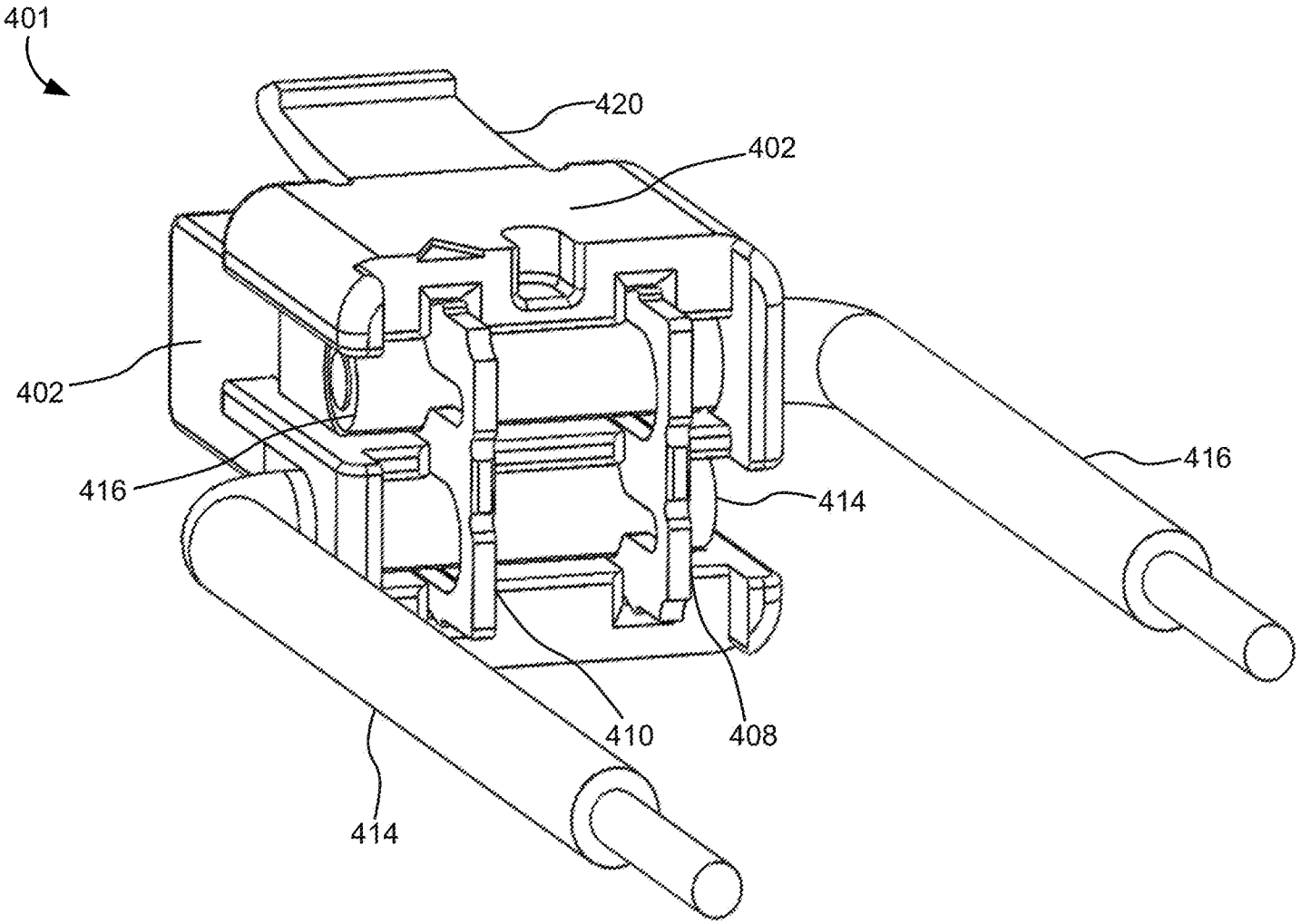
FIG. 7 depicts a perspective view of a wired subassembly of the receptacle connector assembly of FIG. 4 in accordance with an illustrative embodiment.

Referring now to FIGS. 6 and 7, rear perspective views of the insulated body 401 are depicted. As shown, with insulated cap 406 decoupled from the insulated body 401, main body portion 402 reserves space for the wire terminations of the first receptacle contact 408 and the second receptacle contact 410. Referring specifically to FIG. 7, the terminations of first wire 414 and second wire 416 are depicted. As shown, first wire 414 is disposed below second wire 416 and is configured to pass through second receptacle contact 410 and terminate at first receptacle contact 408. By contrast, second wire 416 is disposed above first wire 414 and is configured to pass through first receptacle contact 408 and terminate at second receptacle contact 410.

Figure 8:
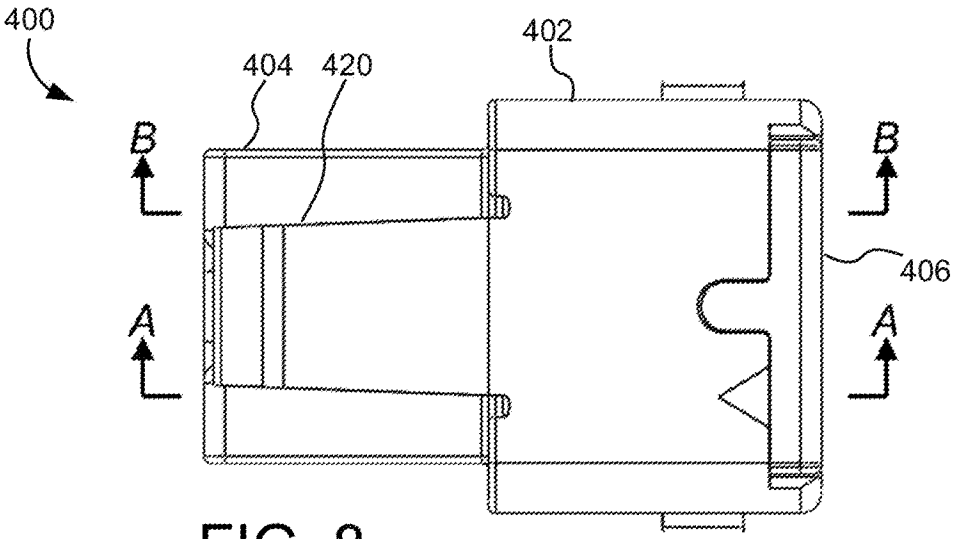
FIG. 8 is a top elevation view of the receptacle connector assembly of FIG. 4 in accordance with an illustrative embodiment.

Turning now to FIGS. 8-13, additional views of the wire terminations of receptacle connector assembly 400 are depicted. Specifically, FIG. 8 depicts a top elevation view of receptacle connector assembly 400, while FIGS. 9 and 10 respectively depict side cross-sectional views of the receptacle connector assembly 400 taken along lines A-A and B-B of FIG. 8. As shown, both first receptacle contact 408 and second receptacle contact 410 include an upper contact prong 422, 424, and a lower contact prong 426, 428. Each pair of prongs (i.e., upper prong 422 and lower prong 426 of first receptacle contact 408, upper prong 424 and lower prong 428 of second receptacle contact 410) may be formed such that the paired prongs are convergent rather than parallel. In addition, each prong 422, 424, 426, 428 is further shown to include an angled termination surface 438, 440, 442, 444. The angled termination surfaces 438, 440, 442, 444 may be utilized to guide the contact blades 118 and 120 of the header connector assembly 100 between the prongs 422, 424, 426, 428 during the mating process.

Each of the first receptacle contact 408 and the second receptacle contact 410 is further shown to include an oval-shaped slot 430, 432 and a keyhole-shaped slot 434, 436. The oval-shaped slot 430 of the first receptacle contact 408 is disposed above the keyhole-shaped slot 436, while the second receptacle contact 410 includes the opposite orientation, with the keyhole-shaped slot 434 disposed above the oval-shaped slot 432. In some embodiments, each of the keyhole-shaped slots 434, 436 may be an insulation displacement slot. In other words, keyhole-shaped slots 434, 436 may be configured to cut through the insulation on the first wire 414 and the second wire 416 to make contact with the wire surrounded by the insulation. In other embodiments, only the keyhole shaped slot 434, 436 is an insulation displacement slot, and the first wire 414 and the second wire 416 are able to pass through the oval-shaped slot 430, 432 without the slot displacing or cutting into the insulation. Instead, the oval-shaped slot 430, 432 may act as strain relief for the first wire 414 and the second wire 416. In addition to the strain relief provided by the first receptacle contact 408 and the second receptacle contact 410, the main body portion 402 may include various strain relief features (e.g., grooves, notches, recesses) to protect the first wire 414 and the second wire 416.

Figure 11:
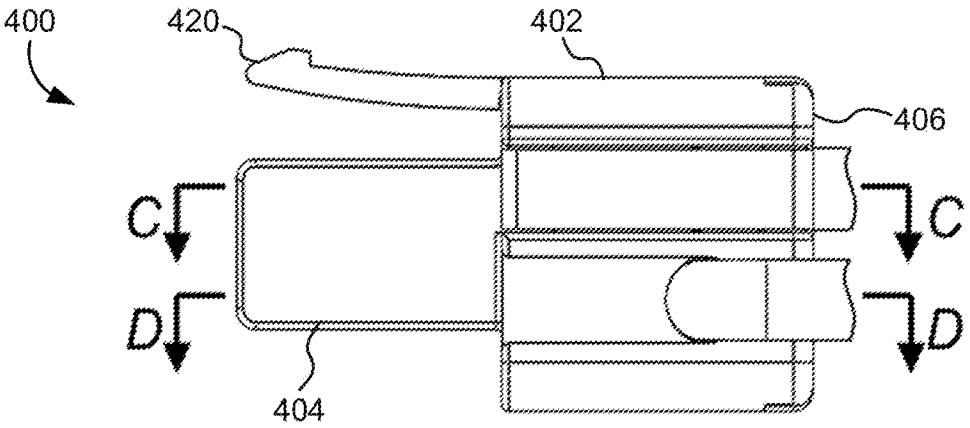
FIG. 11 is a side elevation view of the receptacle connector assembly of FIG. 4 in accordance with an illustrative embodiment.
Figure 12:
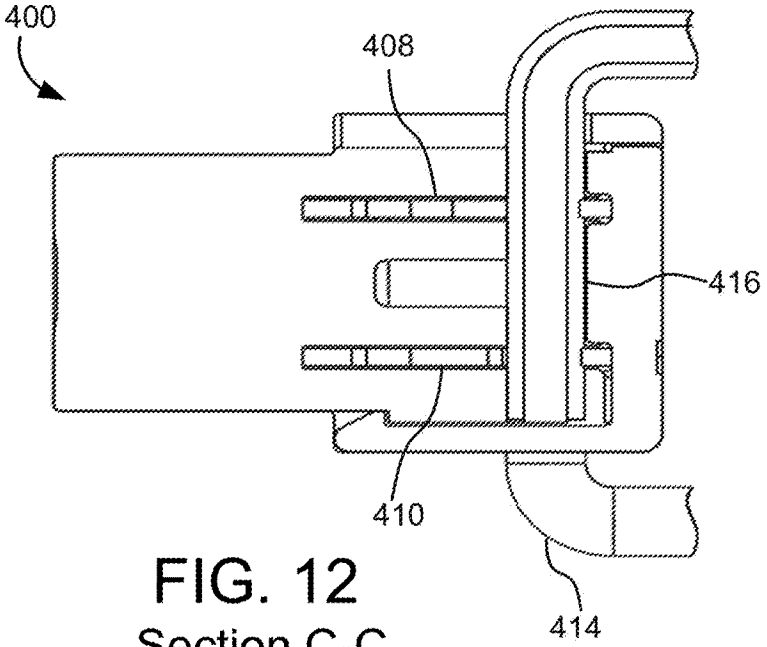
FIG. 12 is a top cross-sectional view of the receptacle connector assembly taken along the line C-C of FIG. 11, in accordance with an illustrative embodiment.
Figure 13:
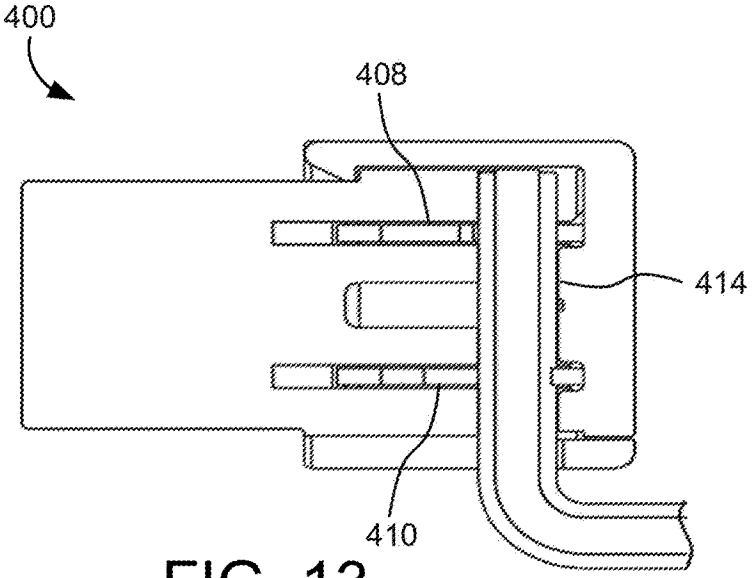
FIG. 13 is a top cross-sectional view of the receptacle connector assembly taken along the line D-D of FIG. 11, in accordance with an illustrative embodiment.

FIG. 11 depicts a side elevation view of receptacle connector assembly 400, while FIGS. 12 and 13 respectively depict top cross-sectional views of the receptacle connector assembly 400 taken along lines C-C and D-D of FIG. 11. As shown, each of the first wire 414 and the second wire 416 contacts both the first receptacle contact 408 and the second receptacle contact 410. As depicted in FIG. 12, second wire 416 may be situated above the first wire 414. Upon entry to the main body portion 402, the second wire 416 may pass through the oval-shaped slot of the first receptacle contact 408 before terminating near the keyhole-shaped slot of the second receptacle contact 410. Similarly, as depicted in FIG. 13, upon entry to the main body portion 402, the first wire 414 may pass through the oval-shaped slot of the second receptacle contact 410 before terminating near the keyhole-shaped slot of the first receptacle contact 408.

Figure 15:
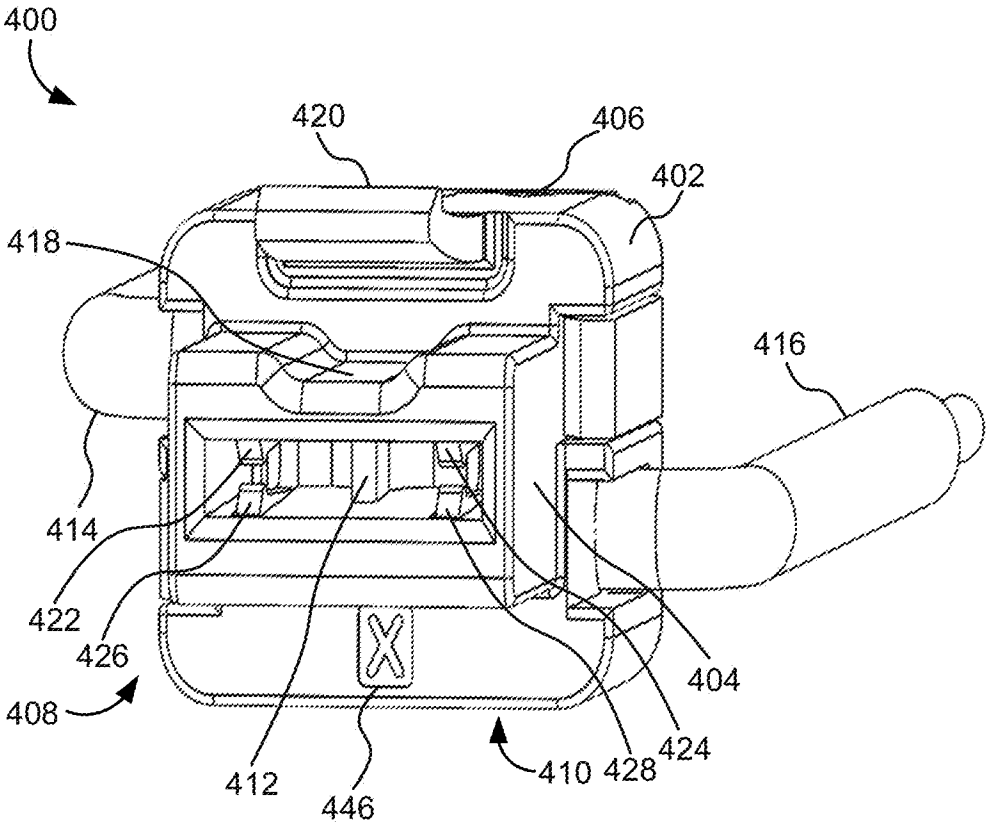
FIG. 15 depicts another perspective view of the receptacle connector assembly of FIG. 4 in accordance with an illustrative embodiment.
Figure 14:
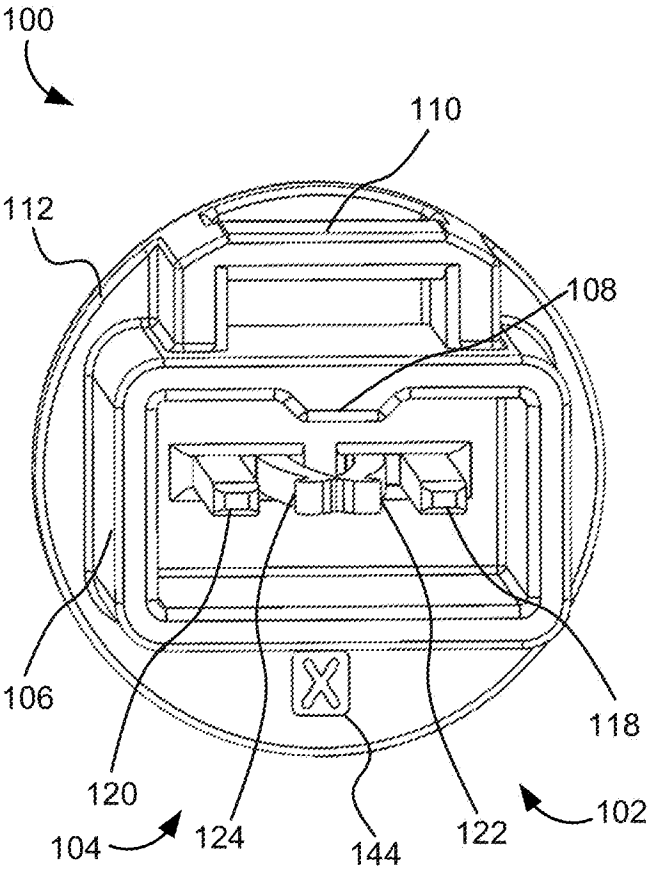
FIG. 14 depicts another perspective view of the header connector assembly of FIG. 1 in accordance with an illustrative embodiment.

Referring now to FIGS. 14 and 15, perspective views of the header connector assembly 100 and the receptacle connector assembly 400 are respectively depicted, according to an illustrative embodiment. As described above, the header connector assembly 100 houses shorting contacts 102, 104 while the receptacle connector assembly 400 houses receptacle contacts 408, 410. Various alignment features may be included to ensure that an acceptable electrical connection is made between the shorting contacts 102, 104 and the receptacle contacts 408, 410. For example, the header connector assembly 100 includes an alignment tab 108 configured to fit within alignment notch 418 of the receptacle connector assembly 400. Similarly, latch 420 of the receptacle connector 400 is configured to fit within the latching body portion 110 of the header connector assembly 100.

FIGS. 14 and 15 additionally depict mold cavity identifying features 144 and 446 of the header connector assembly 100 and the receptacle connector assembly 400. When multiple molds are used to produce the same part, the mold cavity identifying features 144 and 446 may be helpful to identify the cavity that produced a particular part in order to remedy molding defects. In addition, features 144 and 446 may serve as a visual indicator of the proper relative orientation of the connector assemblies 100 and 400 (e.g., a user is able to discern that the connector assemblies are correctly oriented when both of the features are located at the bottom of the assemblies 100 and 400). As shown, in some embodiments, the mold cavity identifying features 144 and 446 are "X" markings or recesses incorporated into the cylindrical flange portion 112 of the header connector assembly 100 and the main body portion 402 of the receptacle connector assembly 400. In other embodiments, the features 144 and 446 may be any desired marking or geometry.

Turning now to FIGS. 16-21, various cross-sectional views of a mating process for the header connector assembly 100 and the receptacle connector assembly 400 are depicted in accordance with an illustrative embodiment. Specifically, FIGS. 16 and 17 respectively depict top and side cross-sectional views of the connector assemblies 100 and 400 in a first contact position 1600, FIGS. 18 and 19 respectively depict top and side cross-sectional views of the connector assemblies 100 and 400 in a first break position 1800, and FIGS. 20 and 21 respectively depict top and side cross-sectional views of the connector assemblies 100 and 400 in a fully mated position 2000.

Figure 16:
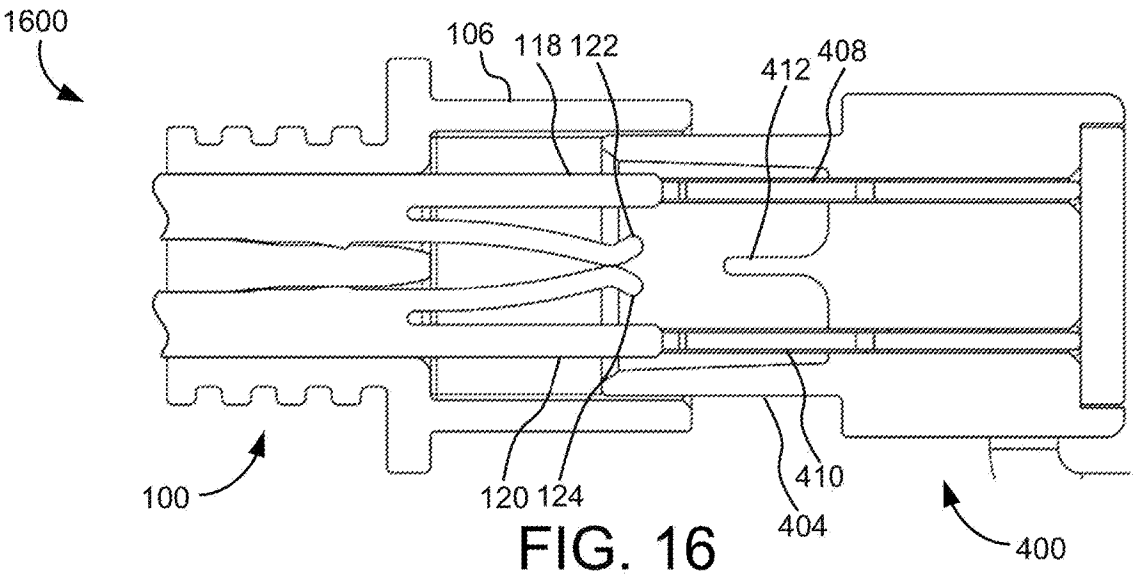
FIG. 16 depicts a top cross-sectional view of the header connector assembly and the receptacle connector assembly in a first contact position in accordance with an illustrative embodiment.
Figure 17:
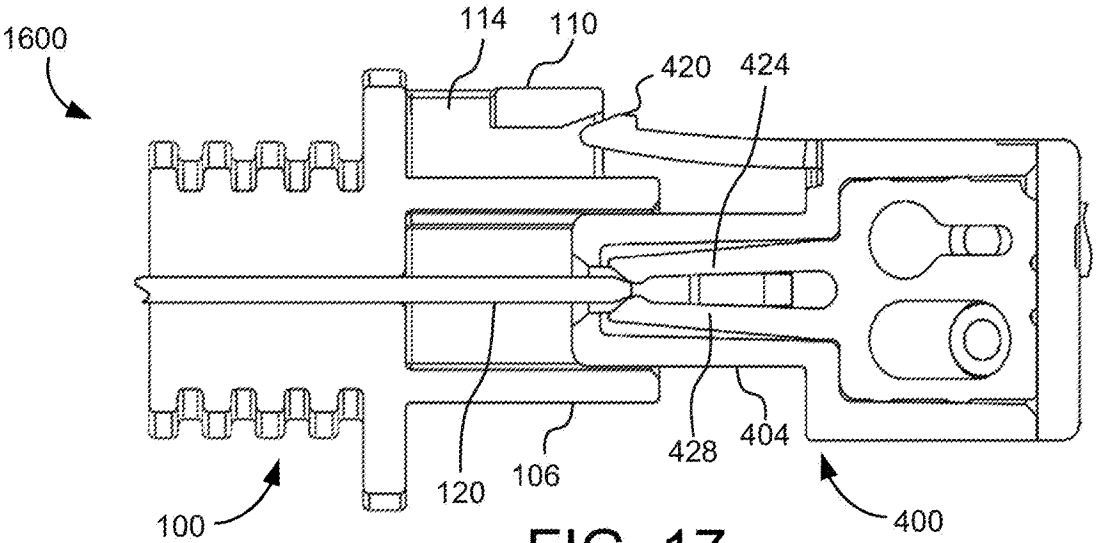
FIG. 17 depicts a side cross-sectional view of the header connector assembly and the receptacle connector assembly in the first contact position of FIG. 16 in accordance with an illustrative embodiment.

As shown in FIGS. 16 and 17, in the first contact position 1600, a minimal portion of mating body portion 404 of the receptacle connector assembly 400 is inserted within the mating body portion 106 of the header connector assembly 100, such that latch 420 does not yet contact latching body portion 110. First shorting beam 122 is in contact with (i.e., touching) second shorting beam 124, and neither is yet in contact with insulating interrupting wall 412. First contact blade 118 and second contact blade 120 are respectively aligned with the first receptacle contact 408 and the second receptacle contact 410. However, as depicted specifically in FIG. 17, this alignment does not result in any deflection of the upper prong 424 and the lower prong 428.

Figure 18:
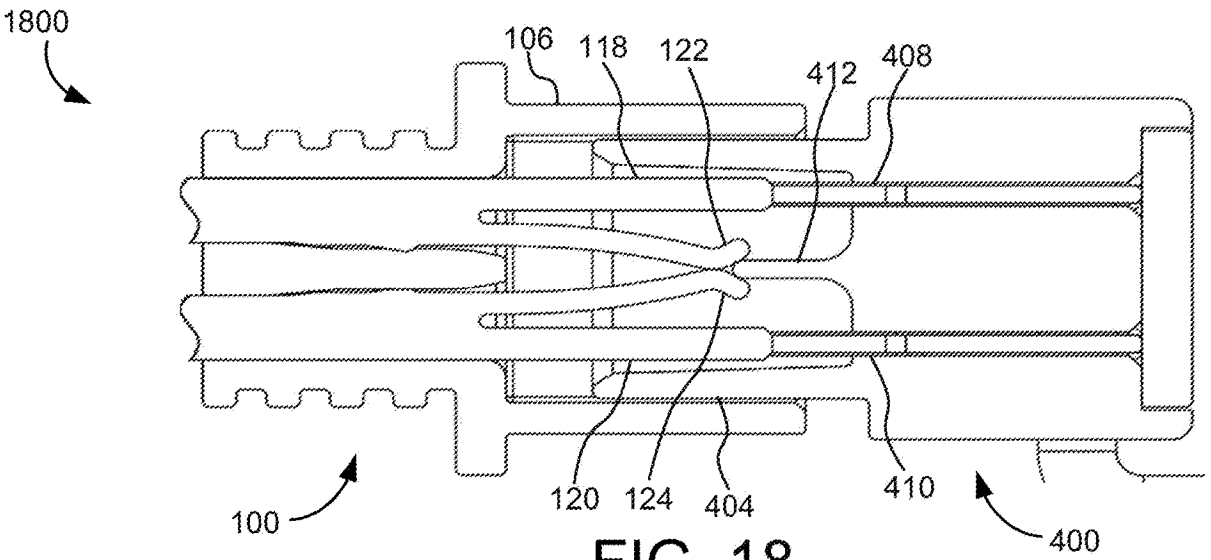
FIG. 18 depicts a top cross-sectional view of the header connector assembly and the receptacle connector assembly in a first break position in accordance with an illustrative embodiment.
Figure 19:
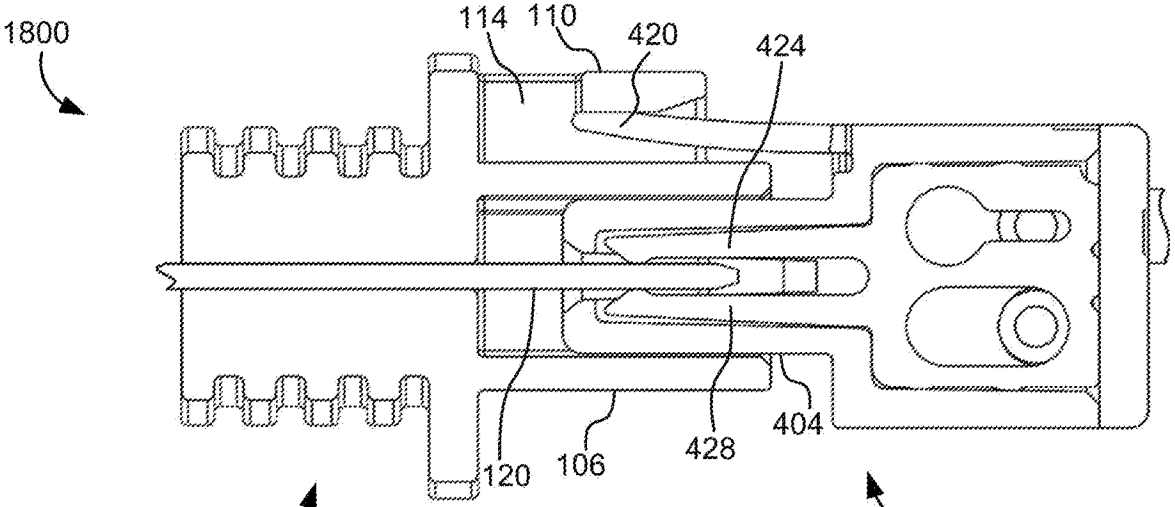
FIG. 19 depicts a side cross-sectional view of the header connector assembly and the receptacle connector assembly in the first break position of FIG. 18 in accordance with an illustrative embodiment.

Continuing with FIGS. 18 and 19, the first break position 1800 is depicted. The first break position 1800 may be representative of an intermediate position between the first contact position 1600 depicted in FIGS. 16 and 17, and the fully mated position 2000 depicted in FIGS. 20 and 21. As shown, in the first break position, a larger portion of mating body portion 404 is inserted within the mating body portion 106 such that latch 420 is deflected toward the mating body portion 404 and located underneath the latching body portion 110. First shorting beam 122 remains in contact with (i.e., touching) second shorting beam 124, and both contact insulating interrupting wall 412. First contact blade 118 and second contact blade 120 are respectively aligned with the first receptacle contact 408 and the second receptacle contact 410, and are partially inserted between the prongs of the first receptacle contact 408 and the second receptacle contact 410. For example, as depicted specifically in FIG. 19, the position of second contact blade 120 in the first break position 1800 results in deflection of the upper prong 424 and the lower prong 428 away from each other and towards the surrounding mating body portion 404.

Figure 20:
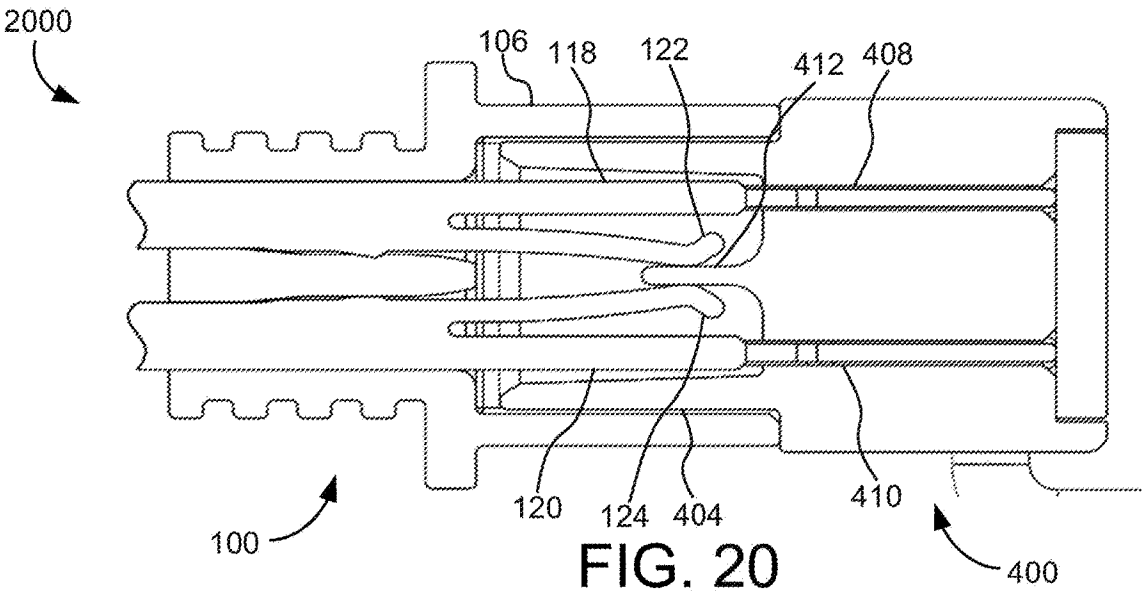
FIG. 20 depicts a top cross-sectional view of the header connector assembly and the receptacle connector assembly in a fully mated position in accordance with an illustrative embodiment.
Figure 21:
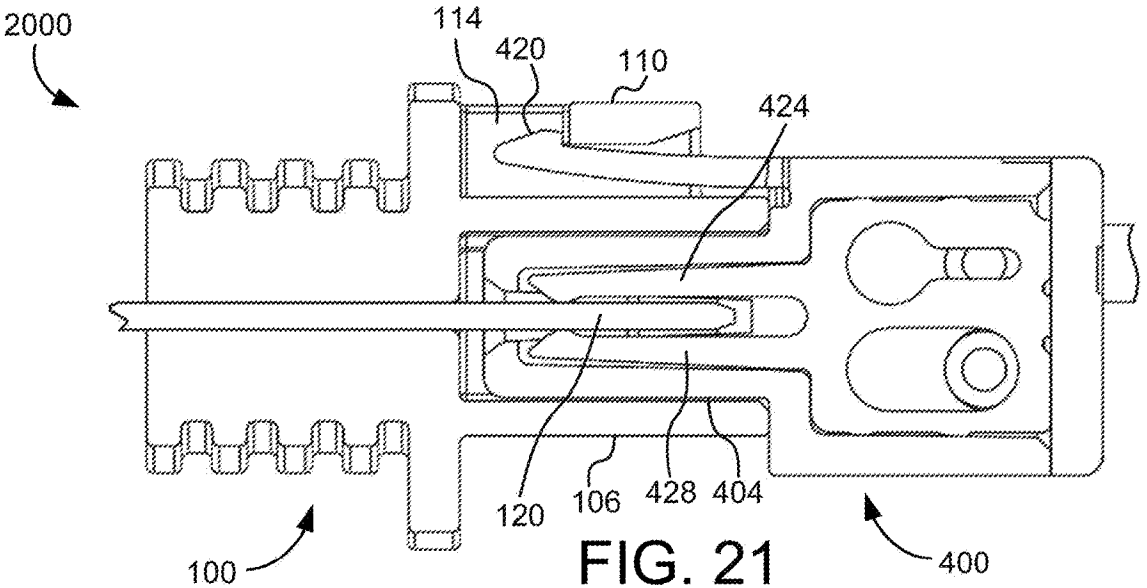
FIG. 21 depicts a side cross-sectional view of the header connector assembly and the receptacle connector assembly in the fully mated position of FIG. 20 in accordance with an illustrative embodiment.

Concluding with FIGS. 20 and 21, the fully mated position 2000 of the header connector assembly 100 and the receptacle connector assembly 400 is depicted. As shown, in the fully mated position 2000, mating body portion 404 may be fully seated within mating body portion 106, such that latch 420 is permitted to spring outwards and away from the mating body portion 404 and into the region of the latch recess 114. First shorting beam 122 is no longer in contact with the second shorting beam 124, and both shorting beams 122, 124 contact the insulating interrupting wall 412 and are deflected toward the first contact blade 118 and the second contact blade 120, respectively. First contact blade 118 is fully inserted (i.e., electrically coupled) between the prongs of the first receptacle contact 408, while second contact blade 120 is fully inserted (i.e. electrically coupled) between the prongs of the second receptacle contact 410.

Figure 22:
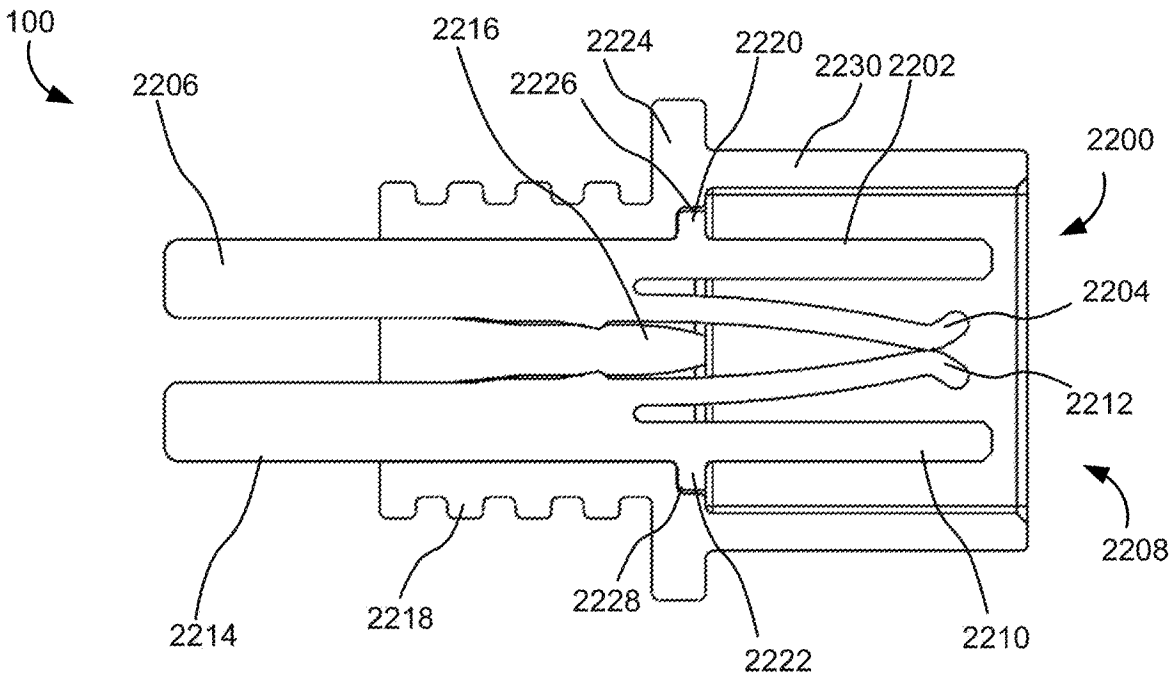
FIG. 22 depicts a top cross-sectional view of the header connector assembly of FIG. 1 in accordance with another illustrative embodiment.

Referring now to FIG. 22, a top cross-sectional view of the header connector assembly 100 is depicted in accordance with another illustrative embodiment. As shown, the header connector assembly 100 includes a first shorting contact 2200 having a first contact blade 2202, a first shorting beam 2204, and a first contact tail 2206 similar to the first shorting contact 102 having the first contact blade 118, the first shorting beam 122, and the first contact tail 126, respectively. The header connector assembly 100 also includes a second shorting contact 2208 having a second contact blade 2210, a second shorting beam 2212, and a second contact tail 2214 similar to the second shorting contact 104 having the second contact blade 120, the second shorting beam 124, and the second contact tail 128, respectively. In some embodiments, the first contact tail 2206 and the second contact tail 2214 may be formed of a Be—Cu alloy for stress retention during heat. Further, similar to FIG. 2, the first shorting contact 2200 and the second shorting contact 2208 may be separated by an insulating wall 2216 of a strain relief portion 2218 such that the only point of contact between the first shorting contact and the second shorting contact is in the region of the first shorting beam 2204 and the second shorting beam 2212 when the header connector assembly 100 is in a nominal (i.e., unmated) configuration.

In contrast to the first shorting contact 102 of FIG. 2, the first shorting contact 2200 of FIG. 22 also includes a first stop shoulder 2220. Similarly, in contrast to the second shorting contact 104 of FIG. 2, the second shorting contact 2208 of FIG. 22 also includes a second stop shoulder 2222. To accommodate the first stop shoulder 2220, a cylindrical flange portion 2224 (which is similar to the cylindrical flange portion 112) of the header connector assembly 100 may define a recess 2226 and to accommodate the second stop shoulder 2222, the cylindrical flange portion may define a recess 2228. The first stop shoulder 2220 and the second stop shoulder 2222 may be configured to provide a snug fit of the first shorting contact 2200 and the second shorting contact 2208 within a mating body portion 2230 (which is similar to the mating body portion 106), as well as to define how far into the mating body portion the first contact blade 2202 and the second contact blade 2210 extend.

Figure 23:
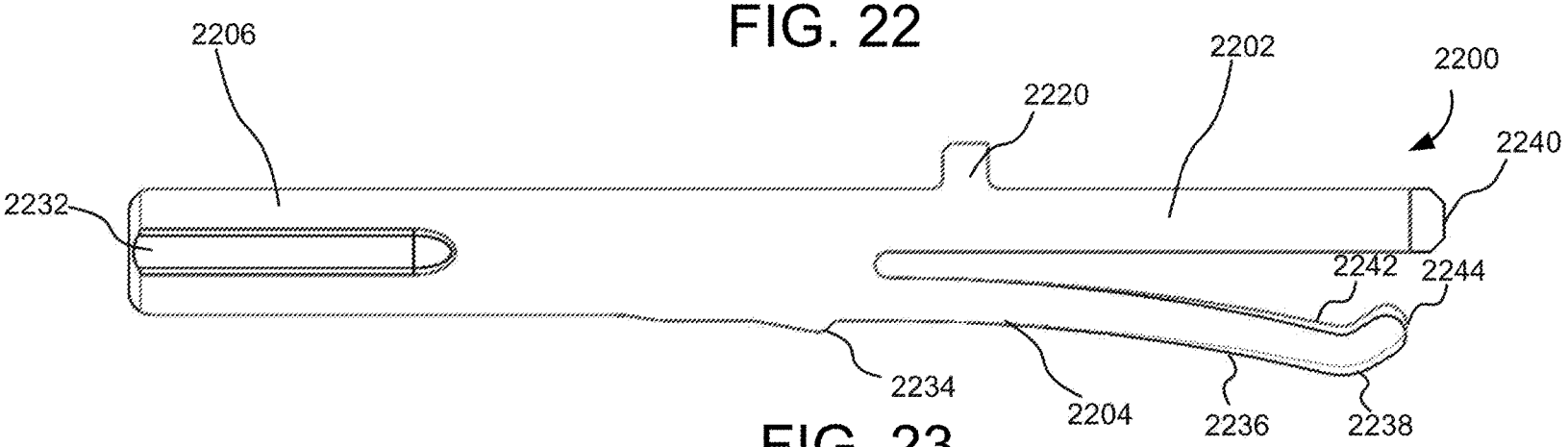
FIG. 23 depicts a top cross-sectional view of a contact with a shorting beam in accordance with another illustrative embodiment.

Turning now to FIG. 23, a top cross-sectional view of the first shorting contact 2200 is depicted. Although the disclosure below is described exclusively with reference to the first shorting contact 2200, the second shorting contact 2208 may be identical or substantially similar to the first shorting contact, and all disclosure is equally applicable to the second shorting contact. The first shorting contact 2200 and second shorting contact 2208 may be fabricated using any suitable process (e.g., a forming process).

As described above, the first shorting contact 2200 is shown to terminate in the first contact tail 2206 with a wire receiving recess 2232 (which is similar to the wire receiving recess 132) at one end. The first shorting contact 2200 is further shown to terminate in the first contact blade 2202 and the first shorting beam 2204 at the opposite end of the first contact tail 2206. The first contact blade 2202 may also include the first stop shoulder 2220. The first contact blade 2202 may be substantially parallel to the first contact tail 2206. Between the first contact tail 2206 and the first shorting beam 2204, the first shorting contact 2200 may include retention features 2234 (similar to the retention features 142). The retention features 2234 along with the first stop shoulder 2220 may be configured to grip the insulating wall 2216 and the cylindrical flange portion 2224, respectively, to prevent removal of the first shorting contact 2200 from the header connector assembly 100. Further, in some embodiments, the first shorting contact 2200 may be similarly sized as the first shorting contact 102. The wire receiving recess 2232 may be configured to terminate a wire using any suitable means (e.g., crimping, soldering). In other embodiments, the wire receiving recess 2232 may be configured to receive another component (e.g., a resistor or capacitor). In still further embodiments, the wire receiving recess 2232 does not receive a wire termination, and the first shorting contact 2200 may instead be soldered to a printed circuit board (PCB).

Still referring to FIG. 23, the first shorting beam 2204 is depicted both in the neutral position and a deflected (e.g., mated) position. The first shorting beam 2204 may include a curved portion 2236 (similar to the curved portion 130) and a bent tip portion 2238 (similar to the bent tip portion 134), both depicted in a neutral position. The curved portion 2236 is shown to extend away from the first contact blade 2202, while the bent tip portion 2238 is shown to extend towards the first contact blade in the neutral position. In some embodiments, a terminating end 2240 of the first contact blade 2202 extends past the terminating end of the bent tip portion 2238. The first shorting beam 2204 may include any dimensions (e.g., radius of curvature, thickness, angle between the curved portion 2236 and the bent tip portion 2238) required to ensure contact with the second shorting beam 2212 when the header connector assembly 100 is in the neutral position, and to permit deflection without deformation when the header connector assembly is in a mating (i.e., deflected) position. In the deflected position, the first shorting beam 2204 may include a curved portion 2242 (similar to the curved portion 136) and a bent tip portion 2244 (similar to the bent tip portion 138). In some embodiments, the neutral position reflects an application of preload to the first shorting beam 2204. The application of preload may ensure that the first shorting beam 2204 and the second shorting beam 2212 remain in contact with each other when the header connector assembly 100 is in an unmated condition. Further details of the mating process for the header connector assembly 100 are included below with reference to FIGS. 25-30.

Figure 24:
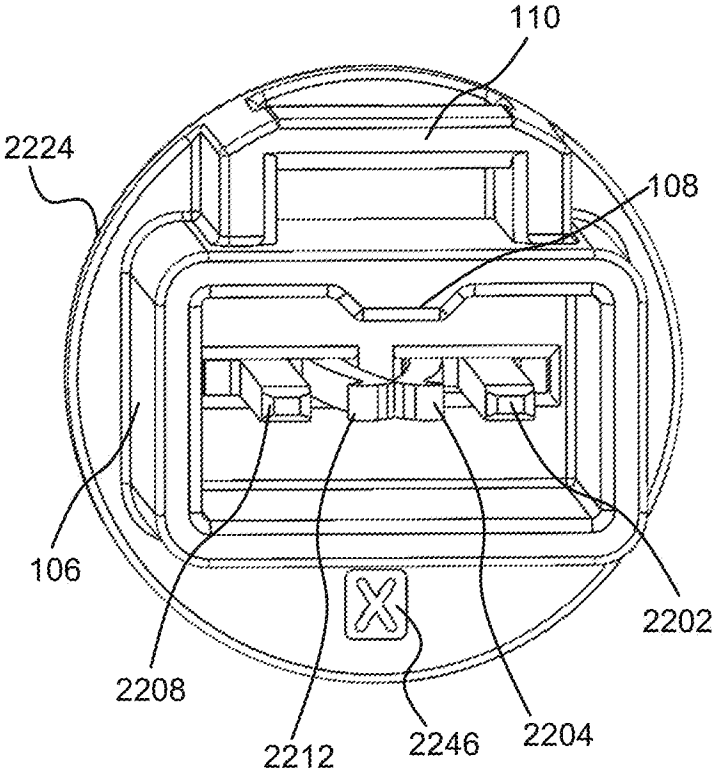
FIG. 24 depicts another perspective view of the header connector assembly of FIG. 1 in accordance with another illustrative embodiment.

FIG. 24 additionally depicts a mold cavity identifying feature 2246 of the header connector assembly 100. When multiple molds are used to produce the same part, the mold cavity identifying feature 2246 may be helpful to identify the cavity that produced a particular part in order to remedy molding defects. In addition, the mold cavity identifying feature 2246 may serve as a visual indicator of the proper relative orientation of the header connector assembly 100 (e.g., a user may be able to discern that the head connector assembly is correctly oriented when the mold cavity identifying feature 2246 is located at the bottom of the head connector assembly 100). As shown, in some embodiments, the mold cavity identifying feature 144 may include "X" or other types of markings or recesses incorporated into the cylindrical flange portion 2224 of the header connector assembly 100. In other embodiments, the mold cavity identifying feature 2246 may be any desired marking or geometry. The header connector assembly 100 of FIG. 22 may be configured to mate with the receptacle connector assembly 400 described in FIG. 15 above.

Turning now to FIGS. 25-30, various cross-sectional views of a mating process for the header connector assembly 100 and the receptacle connector assembly 400 are depicted in accordance with an illustrative embodiment. Specifically, FIGS. 25 and 26 respectively depict top and side cross-sectional views of the header connector assembly 100 and the receptacle connector assembly 400 in a first contact position 2248, FIGS. 27 and 28 respectively depict top and side cross-sectional views of the header connector assembly and the receptacle connector assembly in a first break position 2250, and FIGS. 29 and 30 respectively depict top and side cross-sectional views of the header connector assembly and the receptacle connector assembly in a fully mated position 2252.

Figure 25:
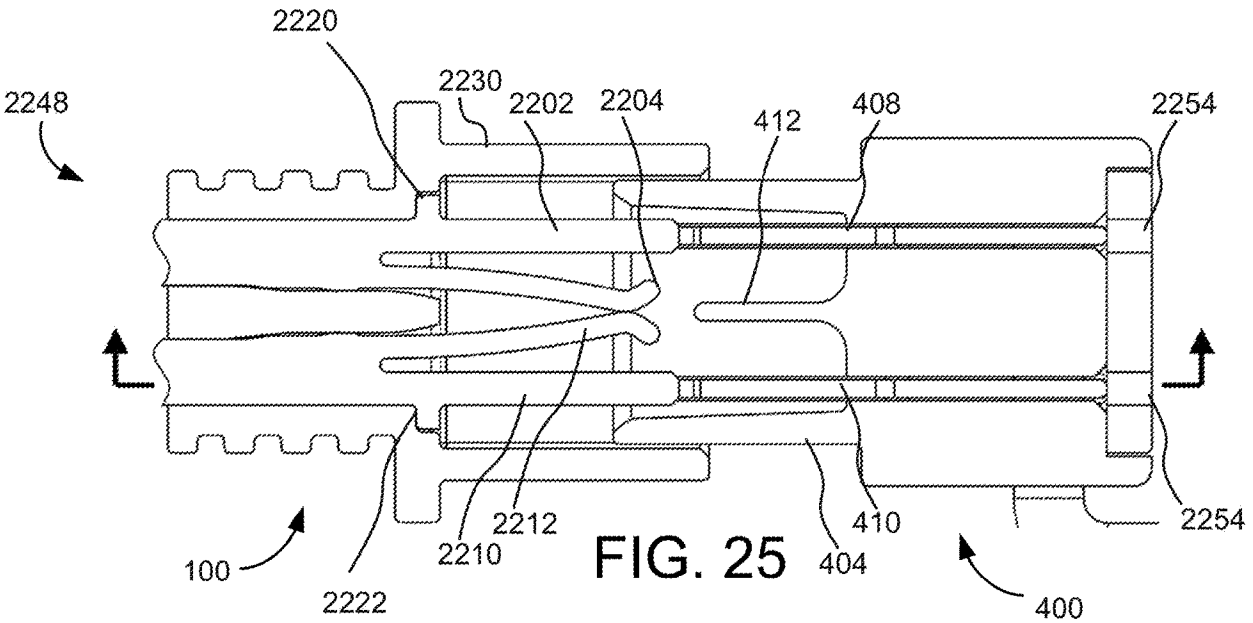
FIG. 25 depicts a top cross-sectional view of the header connector assembly and the receptacle connector assembly in a first contact position in accordance with another illustrative embodiment.
Figure 26:
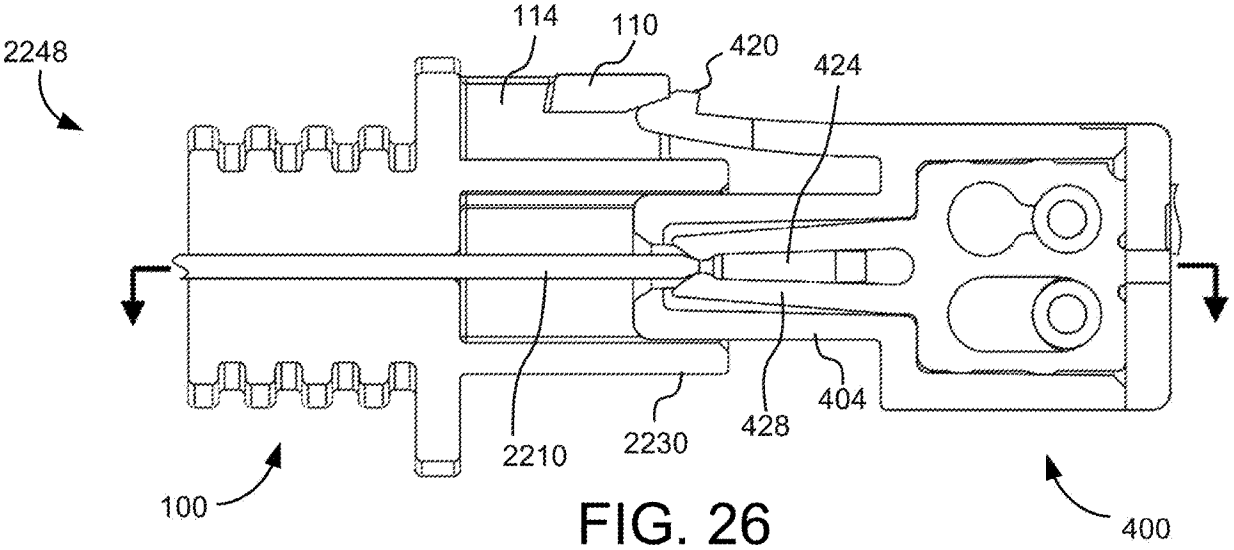
FIG. 26 depicts a side cross-sectional view of the header connector assembly and the receptacle connector assembly in the first contact position of FIG. 25 in accordance with another illustrative embodiment.

As shown in FIGS. 25 and 26, in the first contact position 2248, a minimal portion of the mating body portion 404 of the receptacle connector assembly 400 is inserted within the mating body portion 2230 of the header connector assembly 100, such that the latch 420 contacts the latching body portion 110. The first shorting beam 2204 is in contact with (e.g., touching) the second shorting beam 2212, and neither is yet in contact with the insulating interrupting wall 412. The first contact blade 2202 and the second contact blade 2210 are respectively aligned with the first receptacle contact 408 and the second receptacle contact 410. However, as depicted specifically in FIG. 26, this alignment may not result in any deflection of the upper prong 424 and the lower prong 428. Further, in some embodiments, the receptacle connector assembly 400 may include probe holes 2254 (e.g., 0.55 mm in diameter) for test probe access.

Figure 27:
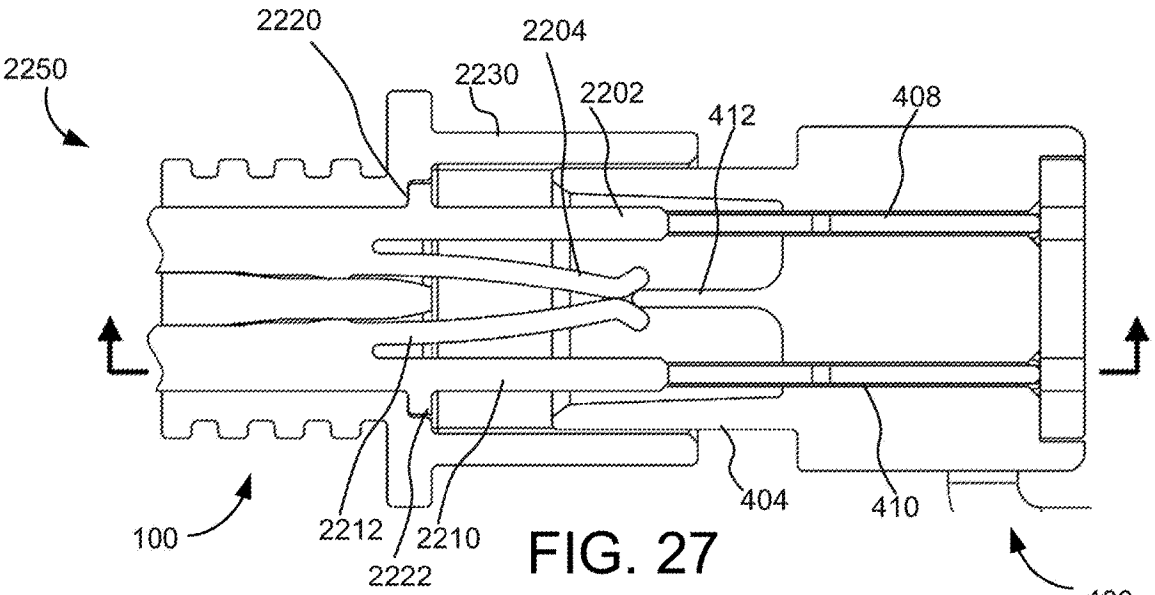
FIG. 27 depicts a top cross-sectional view of the header connector assembly and the receptacle connector assembly in a first break position in accordance with another illustrative embodiment.
Figure 28:
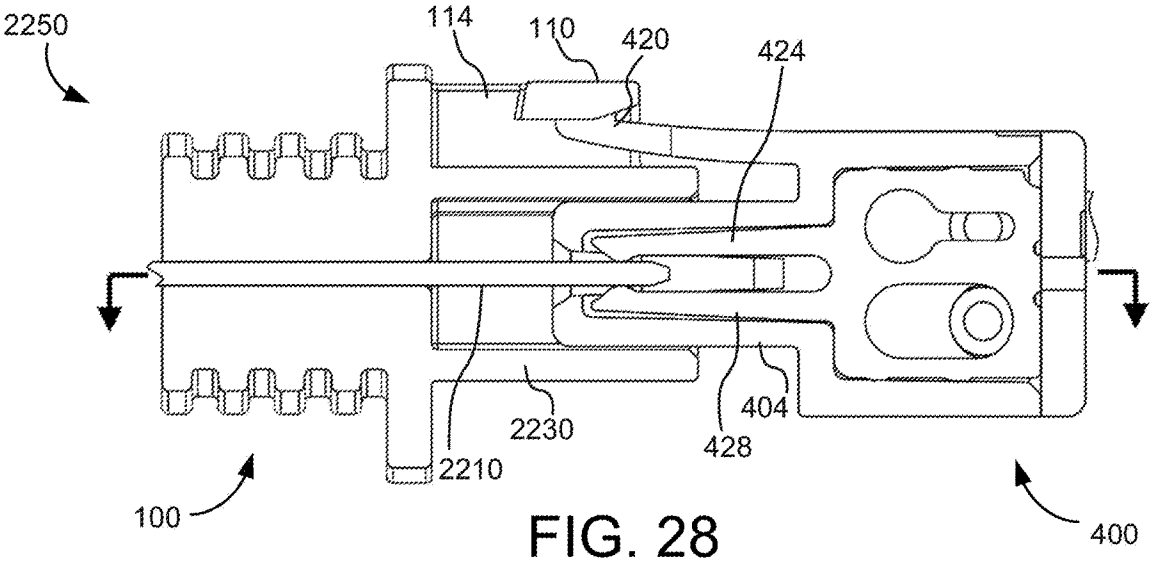
FIG. 28 depicts a side cross-sectional view of the header connector assembly and the receptacle connector assembly in the first break position of FIG. 27 in accordance with another illustrative embodiment.

Continuing with FIGS. 27 and 28, the first break position 2250 is depicted. The first break position 2250 may be representative of an intermediate position between the first contact position 2248 depicted in FIGS. 25 and 26, and the fully mated position 2252 depicted in FIGS. 29 and 30. As shown, in the first break position 2250, a larger portion of the mating body portion 404 is inserted within the mating body portion 2230 such that the latch 420 is deflected toward the mating body portion 404 and located underneath the latching body portion 110. The first shorting beam 2204 remains in contact with (i.e., touching) the second shorting beam 2212, and both contact the insulating interrupting wall 412. The first contact blade 2202 and the second contact blade 2210 are respectively aligned with the first receptacle contact 408 and the second receptacle contact 410, and are partially inserted between the prongs of the first receptacle contact 408 and the second receptacle contact 410. For example, as depicted specifically in FIG. 28, the position of the second contact blade 2210 in the first break position 2250 results in deflection of the upper prong 424 and the lower prong 428 away from each other and towards the surrounding mating body portion 404.

Figure 29:
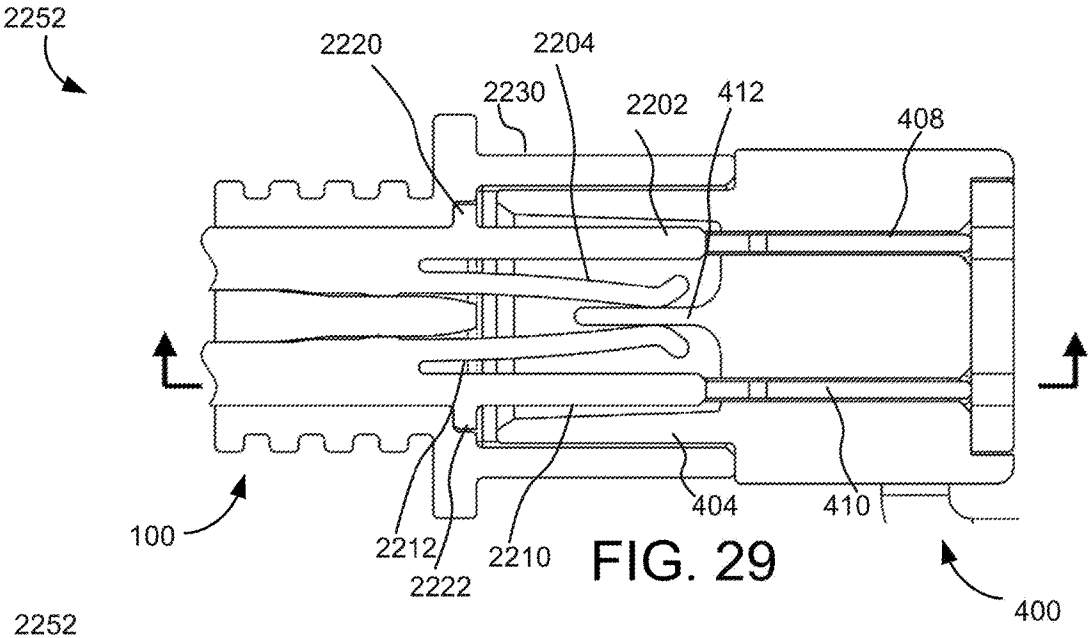
FIG. 29 depicts a top cross-sectional view of the header connector assembly and the receptacle connector assembly in a fully mated position in accordance with another illustrative embodiment.
Figure 30:
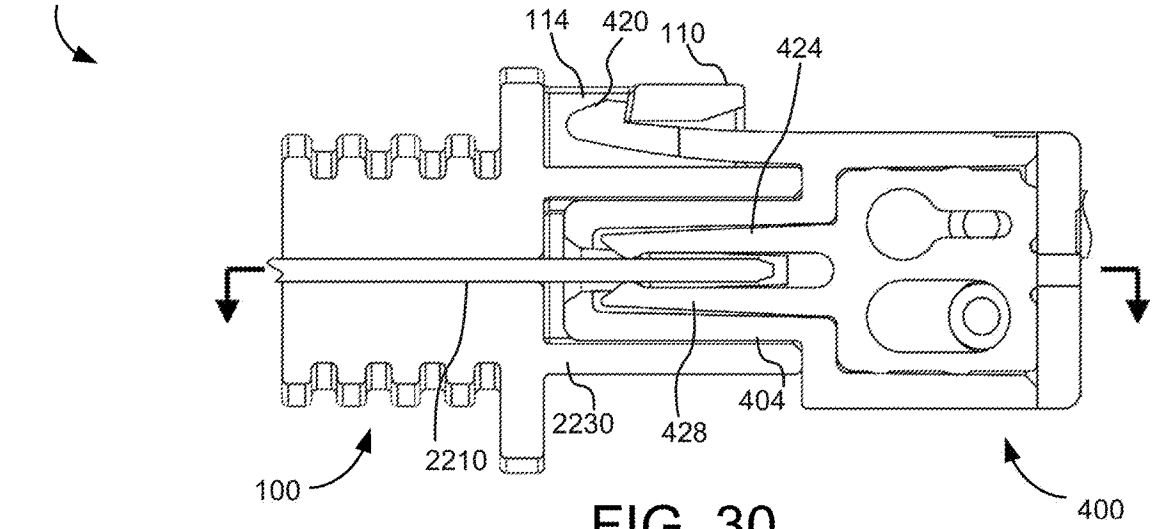
FIG. 30 depicts a side cross-sectional view of the header connector assembly and the receptacle connector assembly in the fully mated position of FIG. 29 in accordance with another illustrative embodiment.

Concluding with FIGS. 29 and 30, the fully mated position 2252 of the header connector assembly 100 and the receptacle connector assembly 400 is depicted. As shown, in the fully mated position 2252, the mating body portion 404 may be fully seated within mating the body portion 2230, such that the latch 420 is permitted to spring outwards and away from the mating body portion 404 and into the region of the latch recess 114. The first shorting beam 2204 is no longer in contact with the second shorting beam 2212, and both shorting beams contact the insulating interrupting wall 412 and are deflected toward the first contact blade 2202 and the second contact blade 2210, respectively. The first contact blade 2202 is fully inserted (i.e., electrically coupled) between the prongs of the first receptacle contact 408, while the second contact blade 2210 is fully inserted (i.e. electrically coupled) between the prongs of the second receptacle contact 410.

In the aforementioned embodiments, the connectors could be fashioned to accommodate a variety of sizes and types of wires. Some embodiments may be made to accommodate a range of wire sizes and types. For example, one connector may be able to accommodate wires from a range of 18 AWG to 14 AWG. AWG refers to the American Wire Gauge sizes. Embodiments may accommodate various insulation thicknesses as well. For example, a connector that accommodates wire sizes of 18 AWG to 14 AWG may accommodate a maximum insulation up to 3.90 mm in diameter. Another embodiment may be sized to accommodate wires from 20 AWG to 12 AWG and accommodate insulation up to 4 mm in diameter.

The shorting and receptacle contacts of the aforementioned embodiments may be made from any suitable material for electrical conductivity. For example, in an exemplary embodiment, the one such contact may be made of phosphor bronze. In other embodiments, the contacts may be fabricated from any high strength copper alloy (e.g., beryllium copper). The insulated bodies of the aforementioned embodiments may be made from any suitable non-electrically conductive material. These materials are well known to those in the art, and may include a variety of plastics and other materials.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

The foregoing description of illustrative embodiments has been presented for purposes of illustration and of description. It is not intended to be exhaustive or limiting with respect to the precise form disclosed, and modifications and variations are possible in light of the above teachings or may be acquired from practice of the disclosed embodiments. It is intended that the scope of the invention be defined by the claims appended hereto and their equivalents.

What is claimed is:

1. A system, comprising:

an electrical header connector assembly, comprising:

an insulated body comprising a mating body portion and a strain relief portion; and a first self-shorting contact and a second self-shorting contact, each of the self-shorting contacts comprising:

a contact tail with a wire receiving recess;

a contact blade extending opposite and substantially parallel to the contact tail; and a shorting beam extending opposite the contact tail and comprising:

a curved portion extending away from the contact blade; and a bent tip portion extending toward the contact blade;

wherein the shorting beam of the first self-shorting contact is configured to touch the shorting beam of the second self-shorting contact when the electrical header is in a neutral position.

2. The system of claim 1, wherein the contact blade and the shorting beam of each of the self-shorting contacts are located within the mating body portion of the insulated body.

3. The system of claim 1, wherein the contact tail of each of the self-shorting contacts is located at least partially within the strain relief portion of the insulated body.

4. The system of claim 1, wherein each of the self-shorting contacts further comprises a retention feature located between the contact tail and the shorting beam.

5. The system of claim 4, wherein the insulated body further comprises an insulating wall located within the strain relief portion.

6. The system of claim 5, wherein the retention feature of each of the self-shorting contacts is configured to grip the insulating wall to prevent decoupling of the self-shorting contacts from the insulated body.

7. The system of claim 1, wherein the insulated body further comprises a latching body portion located above the mating body portion, the latching body portion configured to receive a latch feature of an electrical receptacle connector assembly.

8. The system of claim 1, further comprising:

an electrical receptacle connector assembly, comprising:

an insulated body comprising a main body portion and a mating body portion; and a first receptacle contact and a second receptacle contact, each of the receptacle contacts comprising an upper prong and a lower prong located within the mating body portion.

9. The system of claim 8, wherein the contact blade of the first self-shorting contact is configured to be electrically coupled with upper prong and the lower prong of the first receptacle contact and the contact blade of the second self-shorting contact is configured to be electrically coupled with the upper prong and the lower prong of the second receptacle contact when the electrical header connector assembly and the electrical receptacle connector assembly are in a fully mated position.

10. The system of claim 8, wherein each of the receptacle contacts further comprises a keyhole-shaped slot configured to receive a first wire and an oval-shaped slot configured to receive a second wire.

11. The system of claim 8, wherein the mating body portion of the electrical receptacle connector assembly further comprises an insulating interrupting wall.

12. The system of claim 11, wherein the shorting beam of each of the self-shorting contacts and the insulating interrupting wall are in contact when the electrical header connector assembly and the electrical receptacle connector assembly are in a first break position or a fully mated position.

13. The system of claim 8, wherein the insulated body of the electrical receptacle connector assembly further comprises a latch, and wherein the insulated body of the electrical header connector further comprises a latch recess, the latch configured to fit within the latch recess to prevent decoupling when the electrical header connector assembly and the electrical receptacle connector assembly are in a fully mated position.

14. A self-shorting contact for an electrical connector, comprising:

a contact tail with a wire receiving recess;

a contact blade extending opposite and substantially parallel to the contact tail;

a shorting beam extending from a surface of the self-shorting contact opposite the contact tail and comprising:

a curved portion extending away from the contact blade; and a bent tip portion extending toward the contact blade;

a retention feature extending from the surface of the self-shorting contact opposite the contact tail; and a stop shoulder extending from an opposite surface of the self-shorting contact as the surface of the self-shorting contact from which the retention feature extends.

15. The self-shorting contact of claim 14, wherein the retention feature is located between the contact tail and the shorting beam.

16. The self-shorting contact of claim 14, wherein the shorting beam is configured to be deflected toward the contact blade when the self-shorting contact is in a mating position.

17. The self-shorting contact of claim 14, wherein a terminating end of the contact blade extends past a terminating end of the bent tip portion.

18. The self-shorting contact of claim 14, wherein the self-shorting contact is fabricated using a forming process.

19. A method of electrically coupling a header connector assembly with self-shorting contacts and a receptacle connector assembly, comprising:

moving the header connector assembly and the receptacle connector assembly to a first contact position, wherein the first contact position comprises:

a first contact blade and a second contact blade of the header connector assembly aligned with a first receptacle contact and a second receptacle contact of the receptacle connector assembly, and a first shorting beam and a second shorting beam of the header connector assembly in contact with each other;

moving the header connector assembly and the receptacle connector assembly to a first break position, wherein the first break position comprises:

the first contact blade in contact with the first receptacle contact and the second contact blade in contact the second receptacle contact; and the first shorting beam and the second shorting beam in contact with each other and an insulating interrupting wall of the receptacle connector assembly;

moving the header connector assembly and the receptacle connector assembly to a fully mated position, wherein the fully mated position comprises:

the first contact blade electrically coupled with the first receptacle contact and the second contact blade electrically coupled with the second receptacle contact; and the first shorting beam and the second shorting beam spaced apart from each other and both in contact with the insulating interrupting wall.

20. The method of claim 19, wherein each of the first shorting beam and the second shorting beam comprises a curved portion and a bent tip portion; and wherein the bent tip portion of each of the first shorting beam and the second shorting beam is in contact with the insulating interrupting wall in the first break position.

21. The self-shorting contact of claim 14, wherein the self-shorting contact consists of a single piece of electrically conductive material.

* * * * *